US008641105B2

(12) United States Patent
Goodman et al.

(10) Patent No.: US 8,641,105 B2
(45) Date of Patent: Feb. 4, 2014

(54) SECURING MECHANISMS FOR PARTITIONS, PARTITION SYSTEMS INCLUDING SAME, AND RELATED METHODS

(75) Inventors: E. Carl Goodman, Bountiful, UT (US); Ronald A. Smart, Sandy, UT (US); Craig G. Bell, South Jordan, UT (US)

(73) Assignee: Won-Door Corporation, Salt Lake City, UT (US)

( * ) Notice: Subject to any disclaimer, the term of this patent is extended or adjusted under 35 U.S.C. 154(b) by 280 days.

(21) Appl. No.: 13/013,583

(22) Filed: Jan. 25, 2011

(65) Prior Publication Data

US 2012/0187703 A1 Jul. 26, 2012

(51) Int. Cl.
*E05C 17/56* (2006.01)
*E05C 19/16* (2006.01)

(52) U.S. Cl.
USPC ..... 292/251.5

(58) Field of Classification Search
USPC ..... 292/251.5
See application file for complete search history.

(56) References Cited

U.S. PATENT DOCUMENTS

| | | | | | |
|---|---|---|---|---|---|
| 2,797,655 | A * | 7/1957 | Morehouse | 109/63.5 |
| 3,184,654 | A * | 5/1965 | Bey | 335/295 |
| 3,288,511 | A * | 11/1966 | Tavano | 292/251.5 |
| 3,596,958 | A * | 8/1971 | Bowerman | 292/201 |
| 4,055,824 | A * | 10/1977 | Baermann | 335/288 |
| 4,686,841 | A * | 8/1987 | Prunbauer et al. | 70/276 |
| 6,076,873 | A * | 6/2000 | Jung | 294/65.5 |
| 6,707,360 | B2 * | 3/2004 | Underwood et al. | 335/288 |
| 6,765,330 | B2 * | 7/2004 | Baur | 310/103 |
| 7,267,378 | B2 * | 9/2007 | Drumm | 292/251.5 |
| 7,845,384 | B2 * | 12/2010 | Goodman et al. | 160/118 |
| 7,942,458 | B2 * | 5/2011 | Patterson | 292/251.5 |
| 8,016,330 | B2 * | 9/2011 | Fullerton et al. | 292/251.5 |
| 2007/0007775 | A1 * | 1/2007 | Gallas et al. | 292/251.5 |
| 2009/0027149 | A1 * | 1/2009 | Kocijan | 335/288 |

FOREIGN PATENT DOCUMENTS

| | | | | |
|---|---|---|---|---|
| DE | 145325 | * | 12/1902 | |
| DE | 2455520 | * | 5/1976 | |
| JP | 54013000 | A * | 1/1979 | E05C 19/16 |
| JP | 54102046 | A * | 8/1979 | E05C 19/16 |
| JP | 54109230 | A * | 8/1979 | E05C 19/16 |
| JP | 5340149 | * | 12/1993 | |
| WO | 0143147 | A1 | 6/2001 | |
| WO | 2007033437 | A1 | 3/2007 | |
| WO | 2009000008 | A1 | 12/2008 | |
| WO | 2010020006 | A1 | 2/2010 | |
| WO | 2010135788 | A1 | 12/2010 | |

* cited by examiner

*Primary Examiner* — Carlos Lugo
(74) *Attorney, Agent, or Firm* — TraskBritt

(57) ABSTRACT

Partition systems comprise a first post member attached to a foldable partition, a securing mechanism attached to the first post member and comprising at least one permanent magnet switch configured to selectively apply a significant attractive magnetic force, and at least another post member comprising a material responsive to the applied significant attractive magnetic force of the at least one permanent magnet switch. Methods of securing a partition system comprise bringing a first post member of a foldable partition proximate at least another post member; and manipulating the at least one permanent magnet switch attached to the first post member to selectively apply a significant attractive magnetic force to the at least another post member.

18 Claims, 10 Drawing Sheets

SECURING MECHANISMS FOR PARTITIONS, PARTITION SYSTEMS INCLUDING SAME, AND RELATED METHODS

TECHNICAL FIELD

Embodiments of the present disclosure relate generally to partitions, and, more particularly, to securing mechanisms for partitions that comprise at least one permanent magnet switch, to partition systems including such securing mechanisms, and to related methods of use.

BACKGROUND

Movable partitions are utilized in numerous situations and environments for a variety of purposes. Such partitions may include, for example, foldable or collapsible doors configured to close-off an opening in order to enclose a room or to subdivide a single large room into one or more smaller rooms. The subdivision of one or more larger areas may be desired, for example, to accommodate the simultaneous meeting of multiple groups. In such applications, movable partitions are useful for providing privacy and noise reduction.

For example, referring to FIG. 1, a movable or folding partition system 100 including one or more accordion-type doors 102A and 102B may be used to subdivide a space into multiple, smaller spaces. The doors 102A and 102B may include a plurality of panels 104, which are connected to one another with hinges 106 or other hinge-like structures. The hinged connection of the panels 104 enables the panels to fold and stack adjacent one another such that the doors 102A and 102B may be compactly stored, for example, in pockets 108 formed in walls 110 of a building when the doors 102A and 102B are in a retracted or folded state. When the doors 102A and 102B are deployed to subdivide an area, the doors 102A and 102B may be displaced along a track 112 to provide the desired barrier.

As shown in FIGS. 1 and 2A, two doors 102A and 102B may be utilized, wherein each door 102A, 102B extends from its associated pocket 108 to cooperatively mate with one another. Referring to FIG. 2A, a cross-sectional view is shown of two doors 102A and 102B (each being shown in a folded state and recessed in pockets 108), which may be referred to as a bi-part configuration. The first door 102A includes a male lead post 114, which is configured to cooperatively mate with the female lead post 116 of the second door 102B when each door is properly extended.

Alternatively, the partition system 100 may comprise a single door, which mates with a stationary structure to form a barrier. As shown in FIG. 2B, a single door 102A may include a male lead post 114 which is configured to mate with a female door post 116' formed in a wall 110.

As can also be seen in FIG. 2B, an accordion-type door 102A may include a first accordion-style partition 118A and a second accordion-style partition 118B which is laterally spaced from, and substantially parallel with, the first partition 118A. Each of the two partitions 118A and 118B has a first end 120 structurally fixed to a floating jamb 122 that is movable within the pocket 108 and a second end 124 that is attached to the lead post 114. Such a configuration may be used, for example, as a sound barrier wherein the first partition 118A acts as a primary barrier, the second partition 118B acts as a secondary barrier, and the space 126 between the two partitions 118A and 118B acts as an insulator or a buffer zone.

In securing two doors such as 102A and 102B to one another, a mechanical latch 128 has conventionally been used. For example, referring to FIGS. 3A, 3B and 4 in conjunction with FIG. 1, one or more latches 128 may be positioned at the leading edge of the lead post 114. When the two doors 102A and 102B are drawn together, the latch or latches 128 may be aligned with associated openings 130 in a front plate 134 (or other structure) of the corresponding female lead post 116 (or female door post 116' as shown in FIG. 2B) and inserted therethrough. A handle 132 or other structure may be mechanically coupled with the latches 128 such that actuation of the handle 132 results in a desired displacement of the latches 128. For example, vertical displacement of the handle 132 may result in the concurrent and proportional vertical displacement of the latches 128 such that the latches, having been inserted through the openings 130, are displaced relative the openings 130 and wedge against the back surface of the front plate 134 of the lead post 116 to effectively interlock therewith and prevent the two doors 102A and 102B from being displaced away from one another. The latches 128 may subsequently be displaced in an opposite direction to enable withdrawal of the latches 128 from the openings 130 and to allow the displacement of the two doors 102A and 102B away from each other so that they may each be retracted back into their associated pockets 108 for storing.

As shown in FIGS. 1 and 4, latches 128 are conventionally formed as structural components, such as hooks or hook-like structures that protrude from the leading edge of the lead post 114. Such a configuration is often considered unsightly when the doors 102A and 102B are not secured to one another in a closed, which may also be characterized as a deployed, state. Such protruding structures can also be an injury hazard as they can catch on a person's clothing or body. Additionally, alignment of such latches 128 with corresponding openings 130, and displacement of the latches 128 once inserted with such openings 130 often requires considerably more effort than might be expected and may be difficult to accomplish for individuals that don't exhibit substantial strength. For example, in larger structures where the height of the doors 102A and 102B are significant, and where multiple hooks are employed, it can sometimes be difficult to align each latch 128 with each corresponding opening 130 in a lateral direction (i.e., along the direction in which the track 112 extends), in a longitudinal direction (i.e., a direction substantially transverse to the direction in which the track 112 extends), or both.

BRIEF SUMMARY

In some embodiments, the present disclosure includes partition systems comprising a first post member attached to a foldable partition, a securing mechanism attached to the first post member and comprising at least one permanent magnet switch configured to selectively apply a significant attractive magnetic force, and at least another post member comprising a material responsive to the applied significant attractive magnetic force of the at least one permanent magnet switch.

In additional embodiments, the present disclosure includes methods of securing a partition system comprising bringing a first post member of a foldable partition proximate at least another post member; and manipulating at least one permanent magnet switch attached to the first post member to selectively apply a significant attractive magnetic force to the at least another post member.

BRIEF DESCRIPTION OF THE DRAWINGS

While the specification concludes with claims particularly pointing out and distinctly claiming that which is regarded as the disclosure, various features and advantages of embodiments of this disclosure may be more readily ascertained from the following description of embodiments of the disclosure when read in conjunction with the accompanying drawings, in which:

DETAILED DESCRIPTION

Illustrations presented herein are not meant to be actual views of any particular device or system, but are merely idealized representations that are employed to describe embodiments of the present disclosure. Additionally, elements common between figures may retain the same numerical designation.

Figure 5:
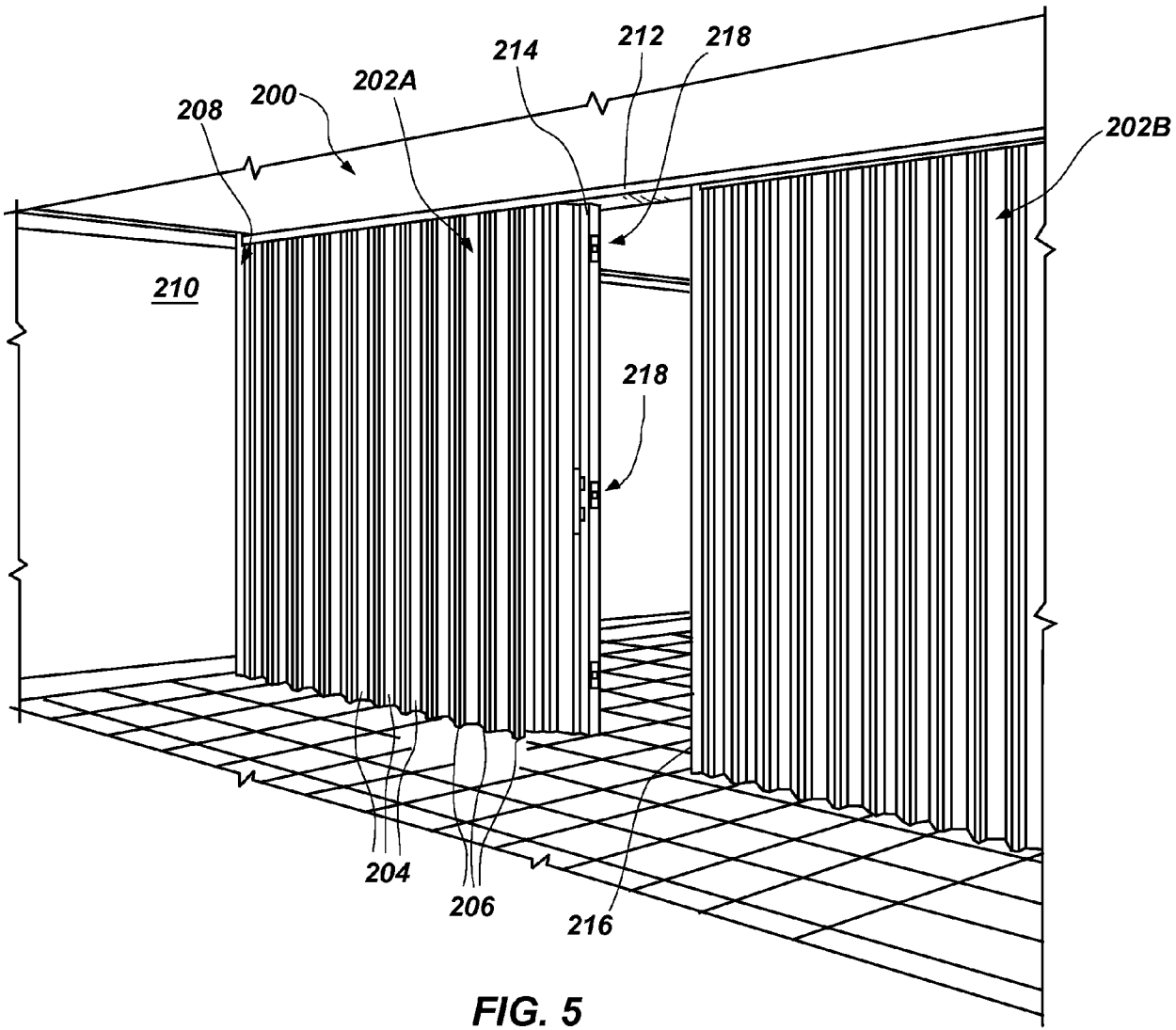
FIG. 5 is an illustration of a partition system according to an embodiment of the present disclosure.
Figure 6:
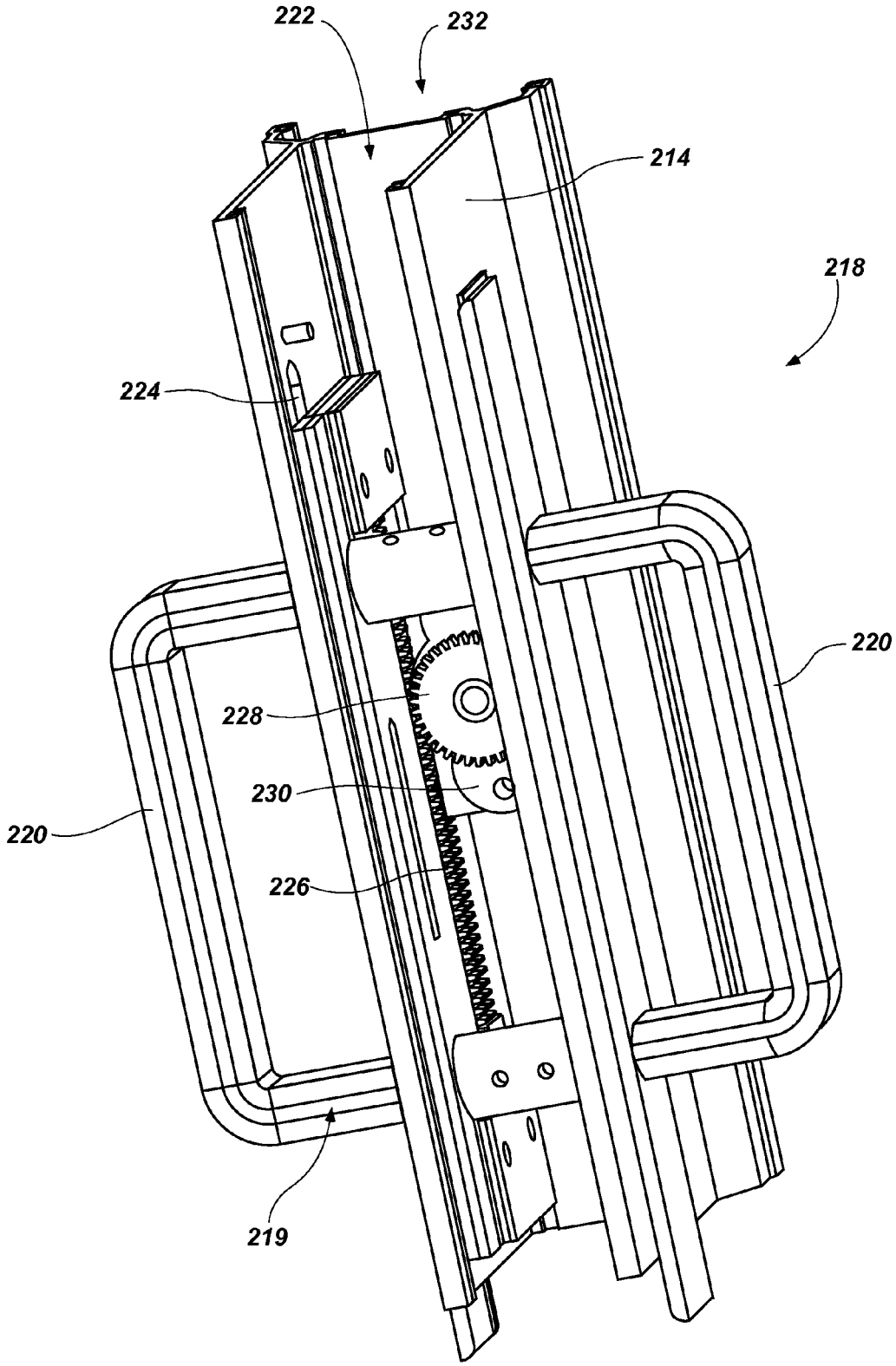
FIG. 6 is a perspective view of a securing mechanism for a partition system according to an embodiment of the present disclosure.
Figure 7:
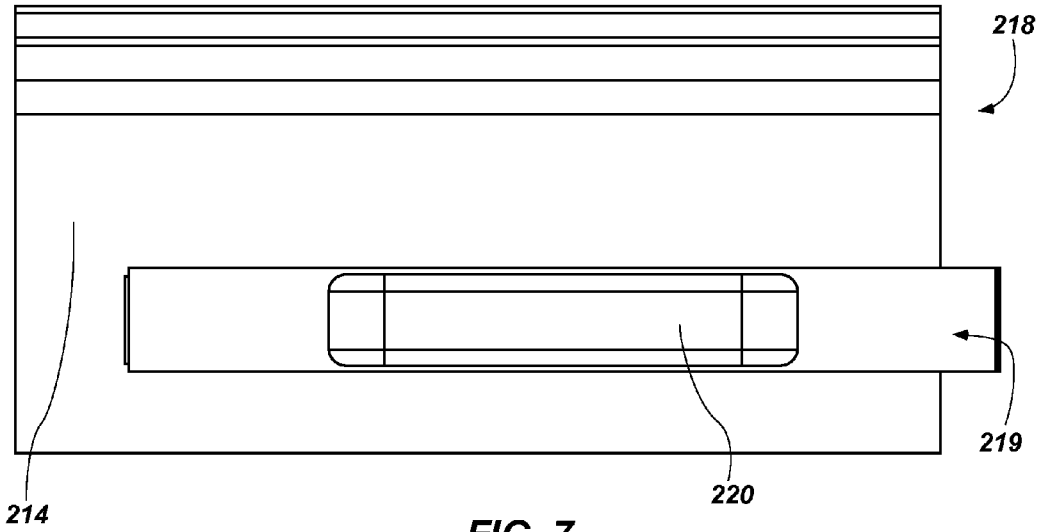
FIG. 7 is a side view of a securing mechanism for a partition system according to an embodiment of the present disclosure.

Referring to FIG. 5, a movable or folding partition system 200 is shown in accordance with an embodiment of the present disclosure. The partition system 200 includes one or more foldable, which may also be termed accordion-type, doors 202A and 202B which may be used to enclose an area or subdivide a space into multiple, smaller spaces. The doors 202A and 202B may each be fanned with a plurality of panels 204, which are connected to one another with hinges 206 or other hinge-like structures. The hinged connection of the panels 204 enables the panels to fold and stack adjacent one another in an accordion or plicated manner such that the doors 202A and 202B may be compactly stored. For example, doors 202A and 202B may be compactly stored in pockets 208 formed in the walls 210 of a building when the doors 202A and 202B are in a retracted or folded state. In other embodiments, pockets 208 may not be formed in the walls 210 and the doors 202A and 202B may be mounted directly to the walls 210 and stored proximate the walls 210 in a retracted and folded state. When the doors 202A and 202B are deployed to subdivide an area, the doors 202A and 202B may be displaced along a track 212 to provide the desired barrier.

Two doors 202A and 202B may be utilized wherein each extends from its associated pocket 208 to cooperatively mate with the other. As previously discussed, such a configuration may be referred to as a bi-part configuration. The first door 202A includes a lead post 214 that is configured to cooperatively mate with a lead post 216 of the second door 202B when each door is properly extended. For example, one lead post may be configured as a so-called "male" lead post while the other may be configured as a so-called "female" lead post. In other embodiments, the partition system 200 may comprise a single door that mates with a stationary structure to form a barrier. For example, a single door (e.g., 202A) may include a male lead post which is configured to mate with a female door post (not shown in FIG. 5) formed in a wall or other structure.

The partition system 200 may include one or more securing mechanisms 218 to maintain the two doors 202A and 202B relative to each other in a closed state, or to secure a single door relative to some other structure (e.g., a wall) in a closed state. The partition system 200 may be configured to be manually operated, automatically operated, or a combination thereof. For example, the partition system 200 may require one or more operators to extend the doors 202A and 202B to faun a barrier or to retract the doors 202A and 202B to a stowed position. Additionally, the partition system 200 may require an operator to manipulate one or more securing mechanisms 218 as will be discussed in further detail hereinbelow.

In additional embodiments, the partition system 200 may be configured or otherwise associated with electric motors, or other drive mechanisms, such that the doors 202A and 202B may be extended to form a barrier or retracted to a stowed position in a substantially automatic manner. Optionally, the partition system 200 may include mechanisms such as electric solenoids so that one or more securing mechanisms 218 may be activated automatically. It is noted that while the following discussion of securing mechanisms is largely described in terms of two doors, or bi-part configurations, the use of the described securing mechanisms is applicable to single door configurations, as well as configurations having three or more doors, as will be appreciated by those of ordinary skill in the art.

Referring to FIGS. 6 through 10, a securing mechanism 218 according to an embodiment of the present disclosure is shown. The securing mechanism 218 comprises two handles 220, such as are conventionally used with a partition system 200. The handles 220 may enable a user to displace a first partition door 202A (FIG. 5) and to actuate the securing mechanism 218 attached to a lead post 214 of the first partition door 202A. The securing mechanism 218 may comprise a handle assembly 219. In other embodiments, the securing mechanism 218 may comprise an electrical actuator, such as, for example, an electric solenoid, that actuates the securing mechanism 218. In still further embodiments, the securing mechanism 218 may comprise a handle assembly 219 having a single displaceable handle. The handles 220 are attached to the lead post 214. For example, the handles 220 may be attached to one another in an interior portion 222 of the lead post 214 through slots 224 formed in the lead post 214. The slots 224 may comprise a size and shape that enables the interconnected handles 220 to slide along the lead post 214 in a longitudinal direction (i.e., a direction substantially transverse to a direction in which the track 212 (FIG. 5) extends) while preventing sliding in a lateral direction (i.e., a direction substantially parallel to the direction in which the track 212 extends). In addition, the handles 220 may be attached to one another through two slots 224, thus preventing the handles 220 from rotating. Thus, longitudinally displacing one of the handles 220 may displace both handles 220, and displacement may be limited to the longitudinal direction by the slots 224.

The handles 220 may further be connected to a rack 226 and pinion 228 in the interior portion 222 of the lead post 214. The rack 226 may be attached to the interconnected handles 220 in the interior portion 222 of the lead post 214. As the handles 220 are displaced in the longitudinal direction, the rack 226 may be displaced an equal distance in the same longitudinal direction. Teeth of the rack 226 may engage teeth of the pinion 228, converting the linear displacement of the rack 226 to rotation of the pinion 228.

The pinion 228 may be operably coupled to a permanent magnet switch 230. The permanent magnet switch 230 may comprise permanent magnets 234 that are movable responsive to rotation of the pinion 228, to selectively apply a significant magnetic field and selectively apply a significant attractive magnetic force without an electrical power source. For example, a significant magnetic field may be applied externally at an end 231 of the permanent magnet switch 230. Permanent magnets 234 within the permanent magnet switch 230 may continuously produce a magnetic field. The permanent magnet switch 230 is manipulated and the permanent magnets 234 move relative to one another, such as, for example, by rotational movement, so that the comparative orientation and magnetic configuration of the permanent magnets 234 may be used to selectively apply a significant magnetic field externally at the end 231 of the permanent magnet switch 230. For example, permanent magnets 234 within the permanent magnet switch 230 may be configured to produce no magnetic field at the end 231 of the permanent magnet switch 230 when in a first orientation. In other embodiments, permanent magnets 234 within the permanent magnet switch 230 may be configured to produce a negligible magnetic field at the end 231 of the permanent magnet switch 230 when in the first orientation. The first orientation may be characterized as an "off" position. Permanent magnets 234 within the permanent magnet switch 230 may be configured to produce a significant magnetic field at the end 231 of the permanent magnet switch 230 when in a second orientation. The second orientation may be characterized as an "on" position.

Figure 11:
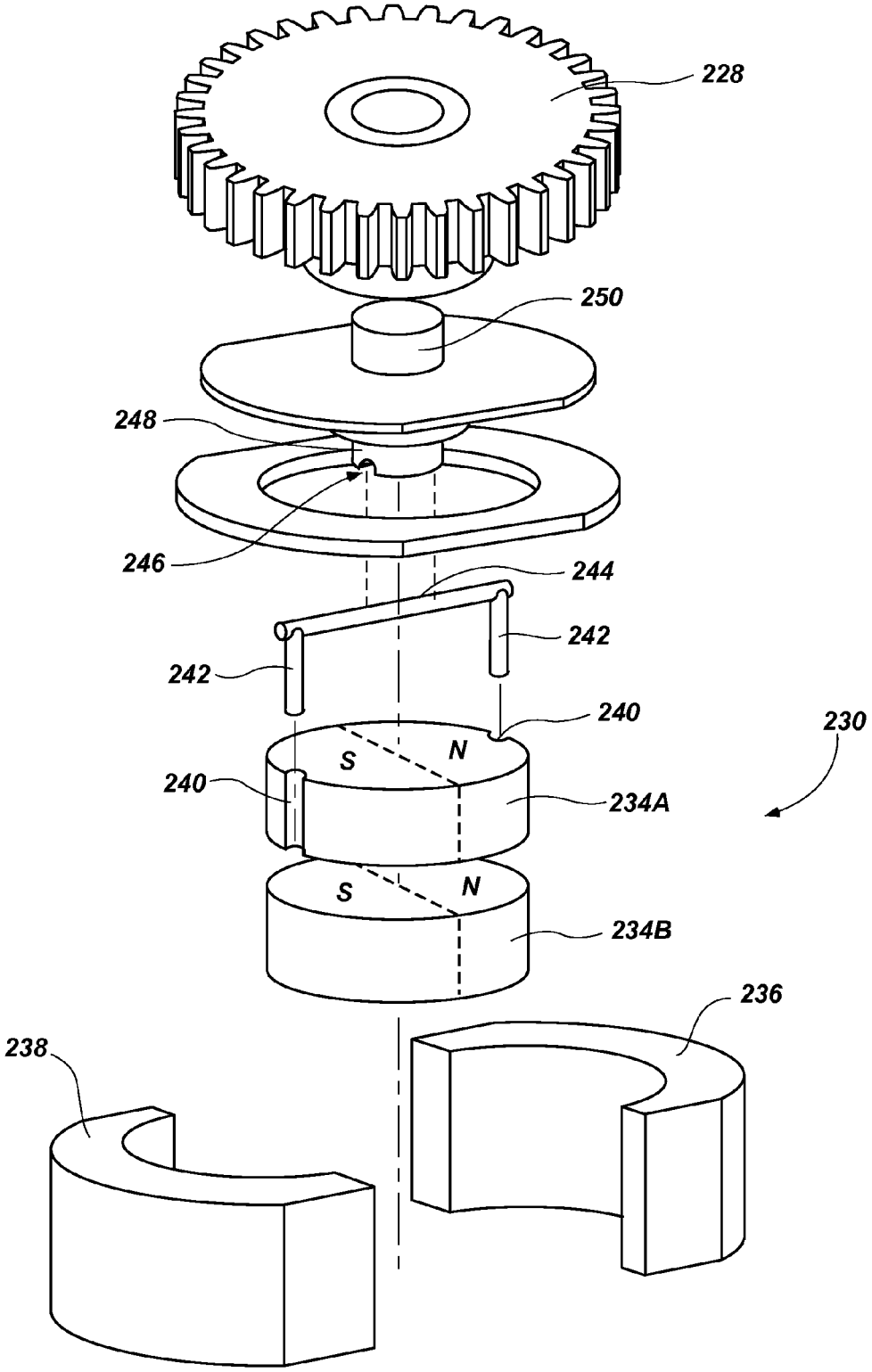
FIG. 11 is an exploded perspective view of a permanent magnet switch for use in a securing mechanism for a partition system according to an embodiment of the present disclosure.
Figure 1:
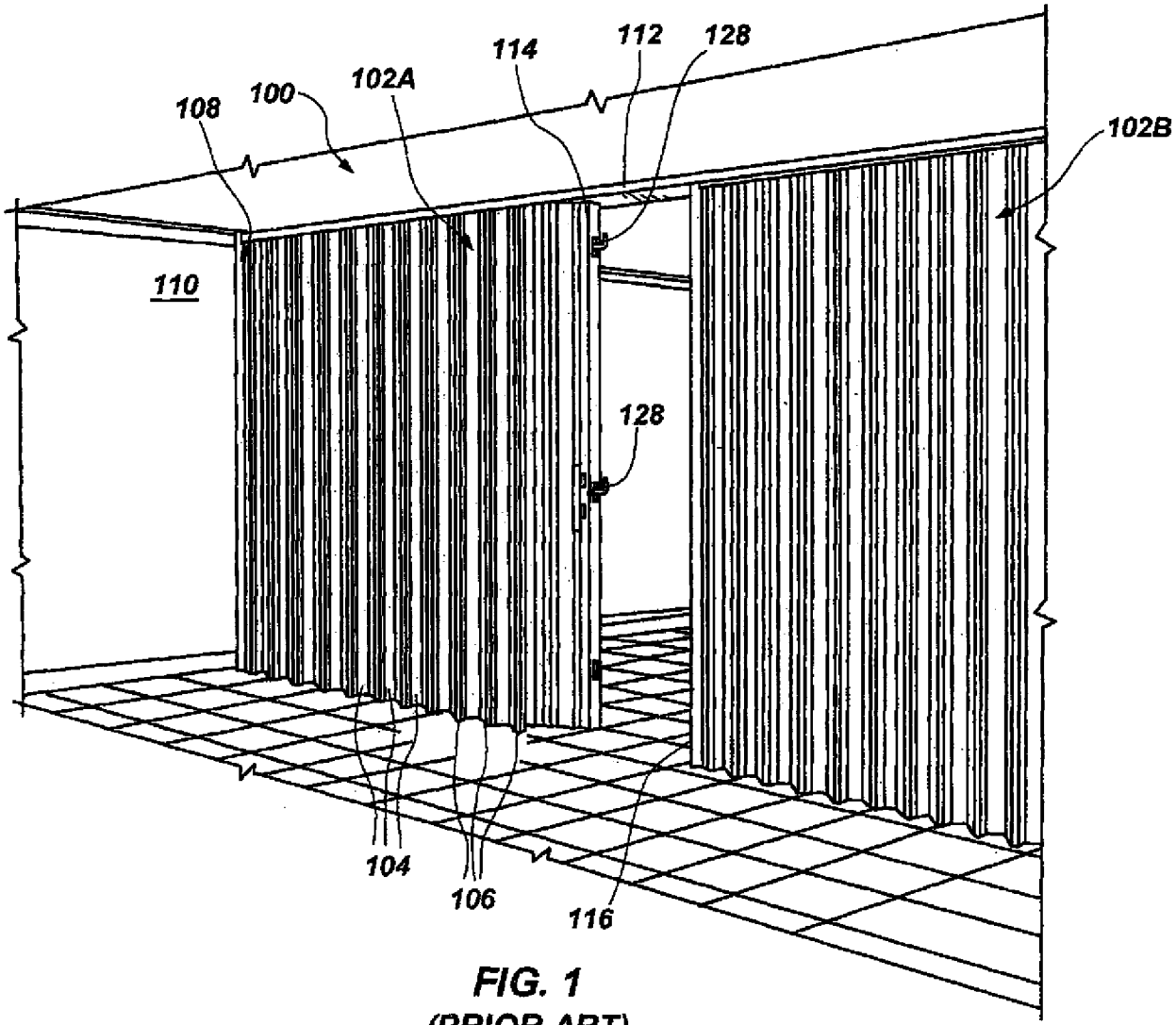
FIG. 1 (PRIOR ART)
Figure 2A:
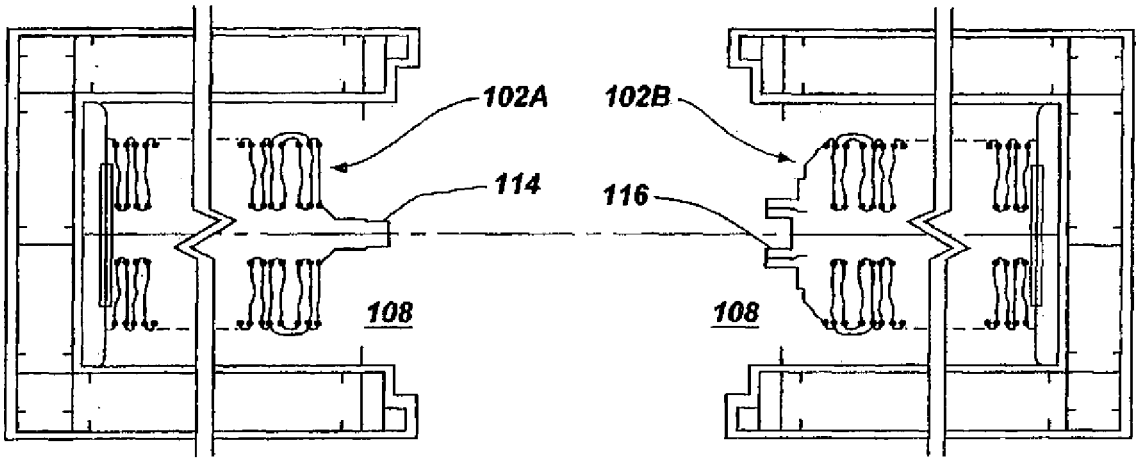
FIG. 2A (PRIOR ART)
Figure 2B:
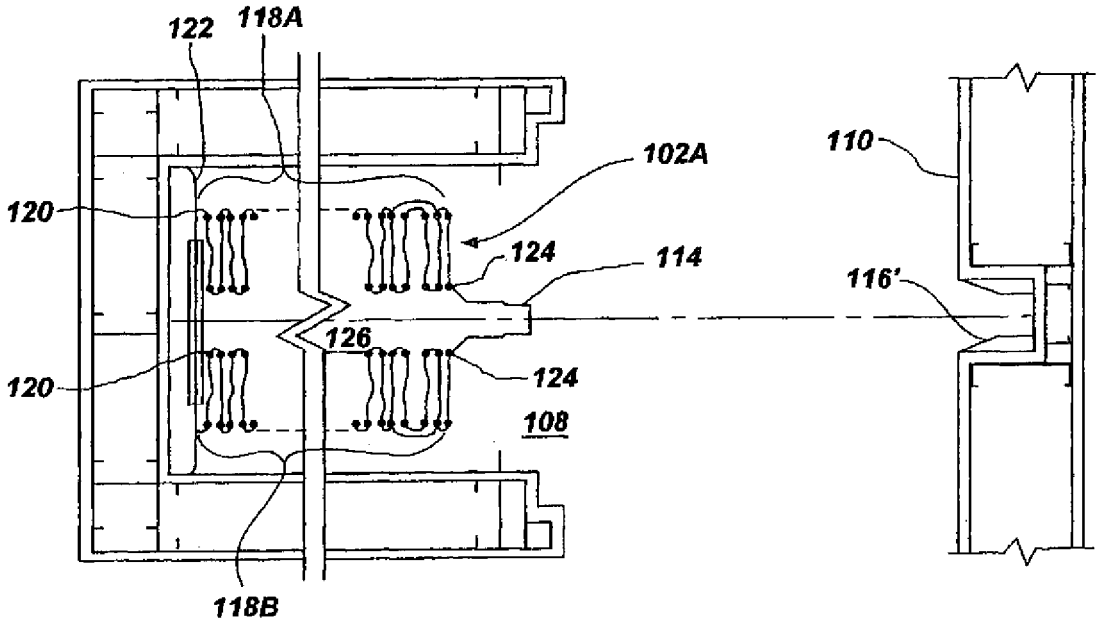
FIG. 2B (PRIOR ART)
Figure 3A:
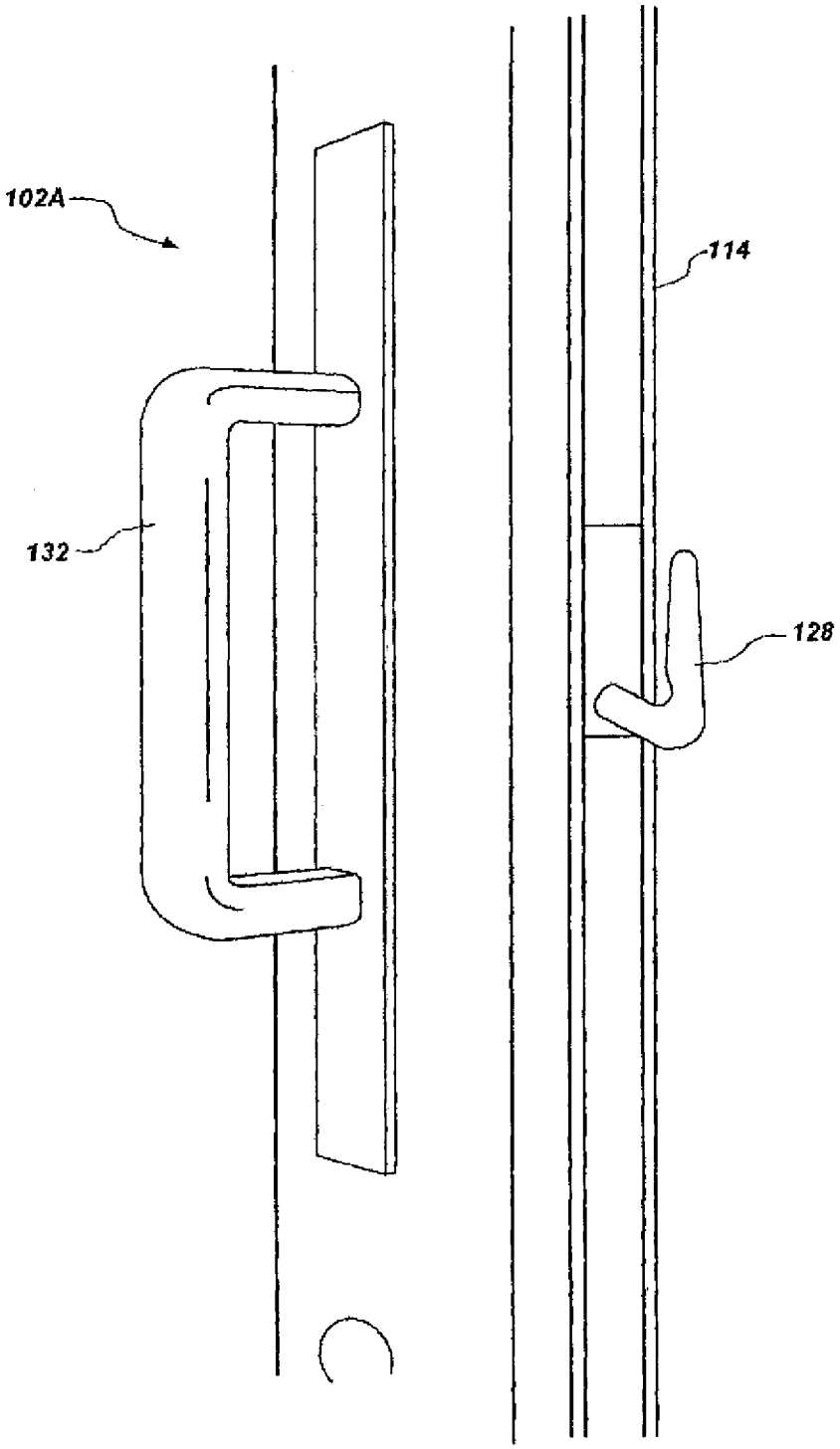
FIG. 3A (PRIOR ART)
FIG. 3A is an illustration of a prior art latch for a partition system.
Figure 3B:
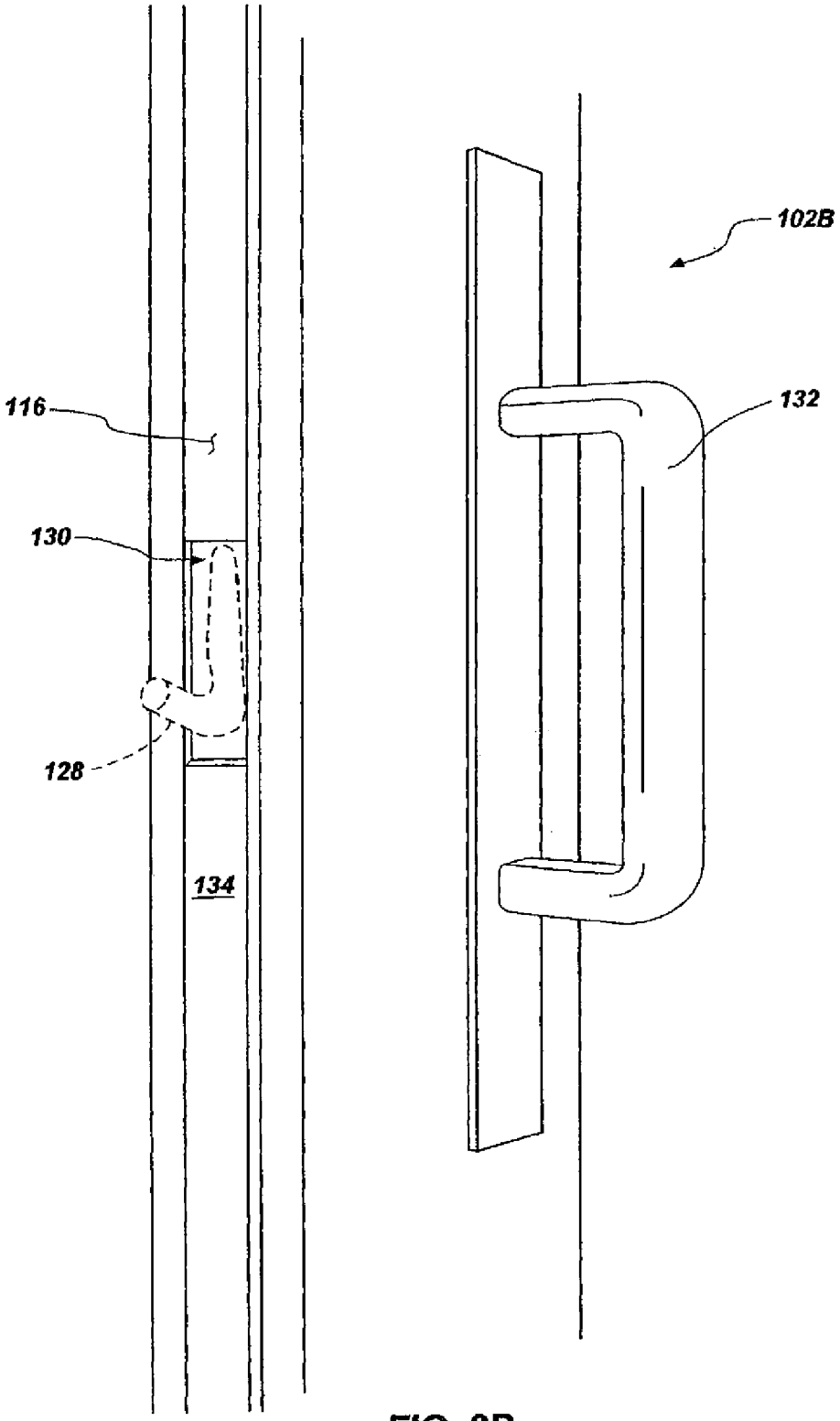
FIG. 3B (PRIOR ART)
Figure 4:
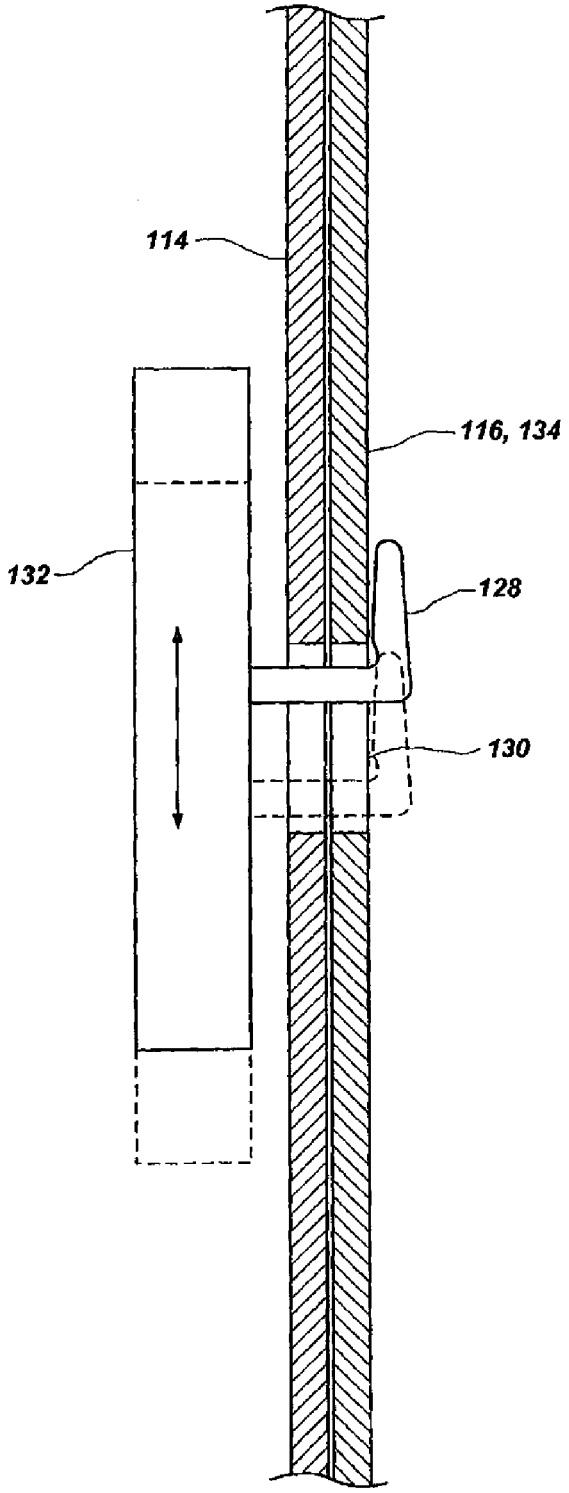
FIG. 4 (PRIOR ART)
Figure 5:
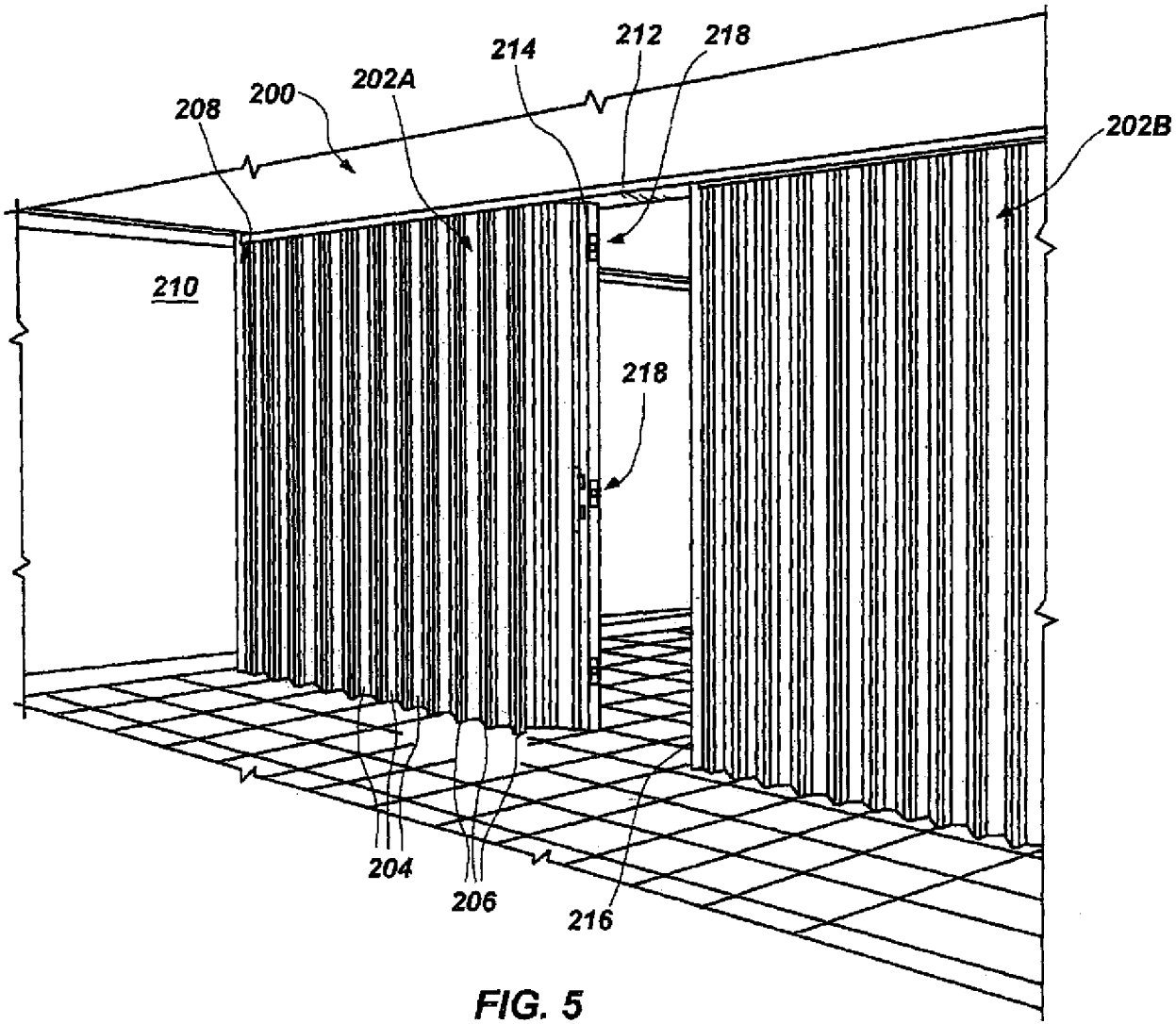
Figure 6:
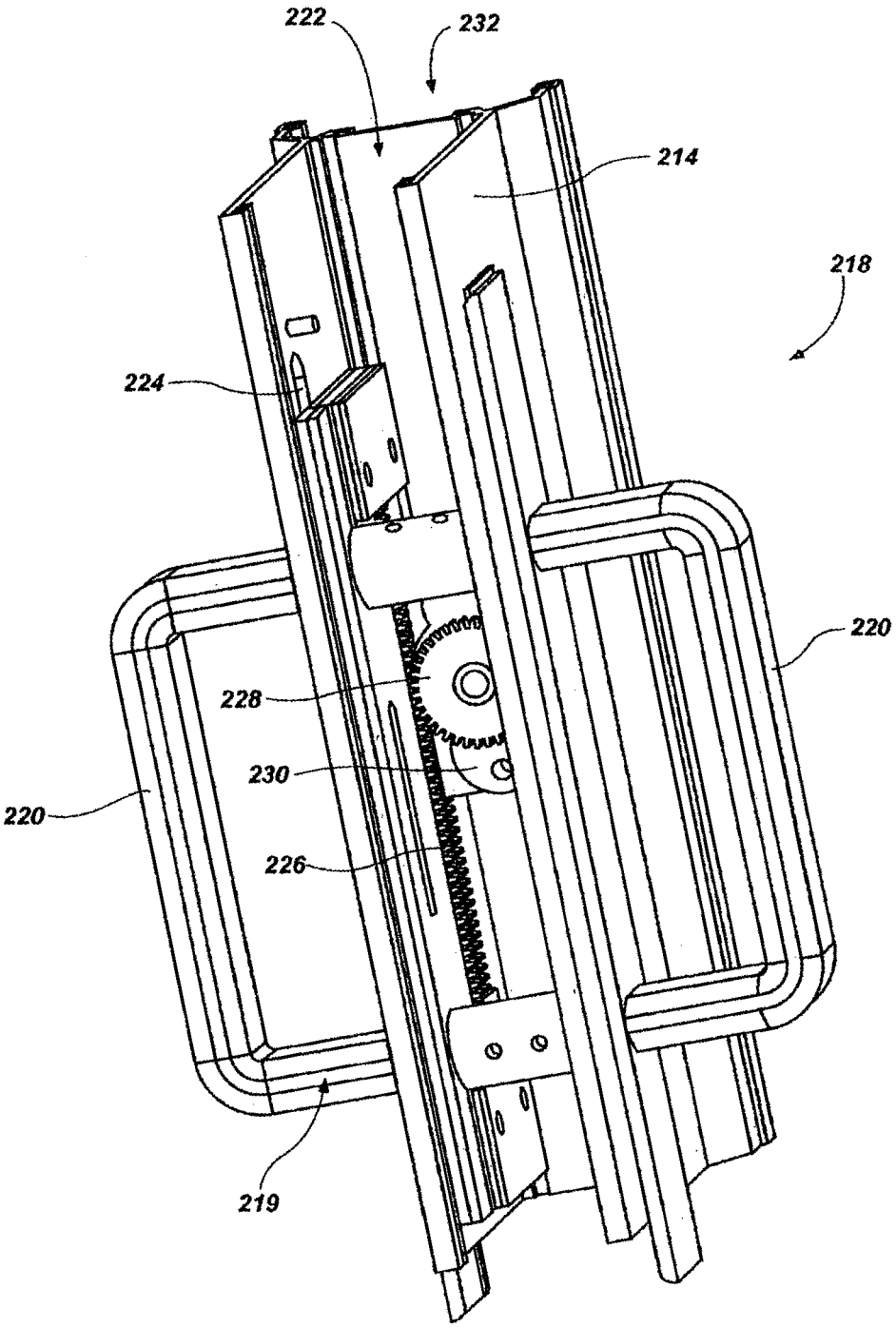
Figure 7:
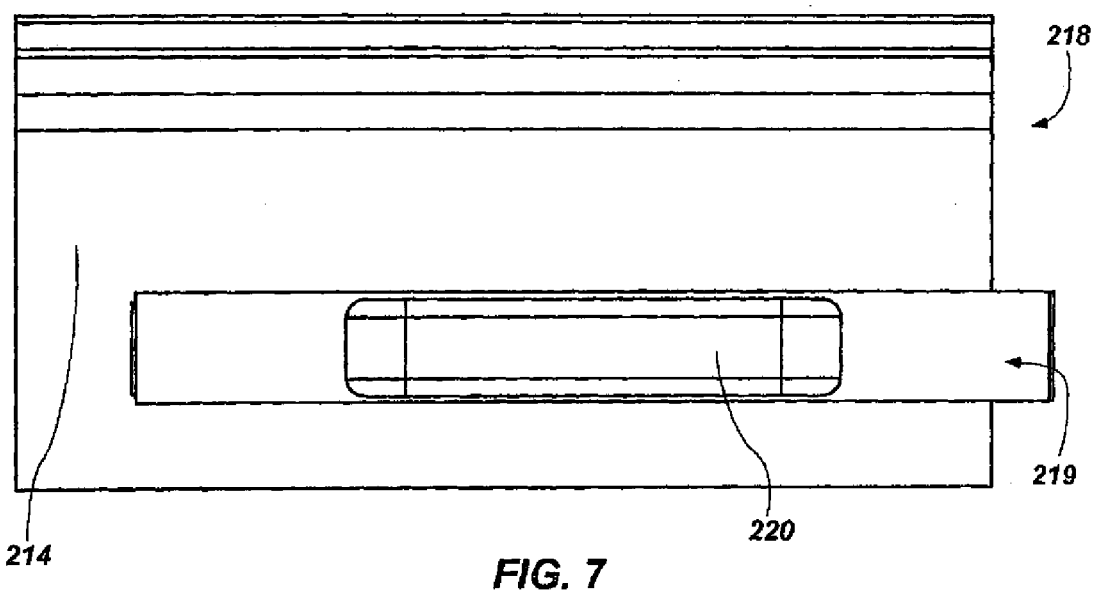
Figure 8:
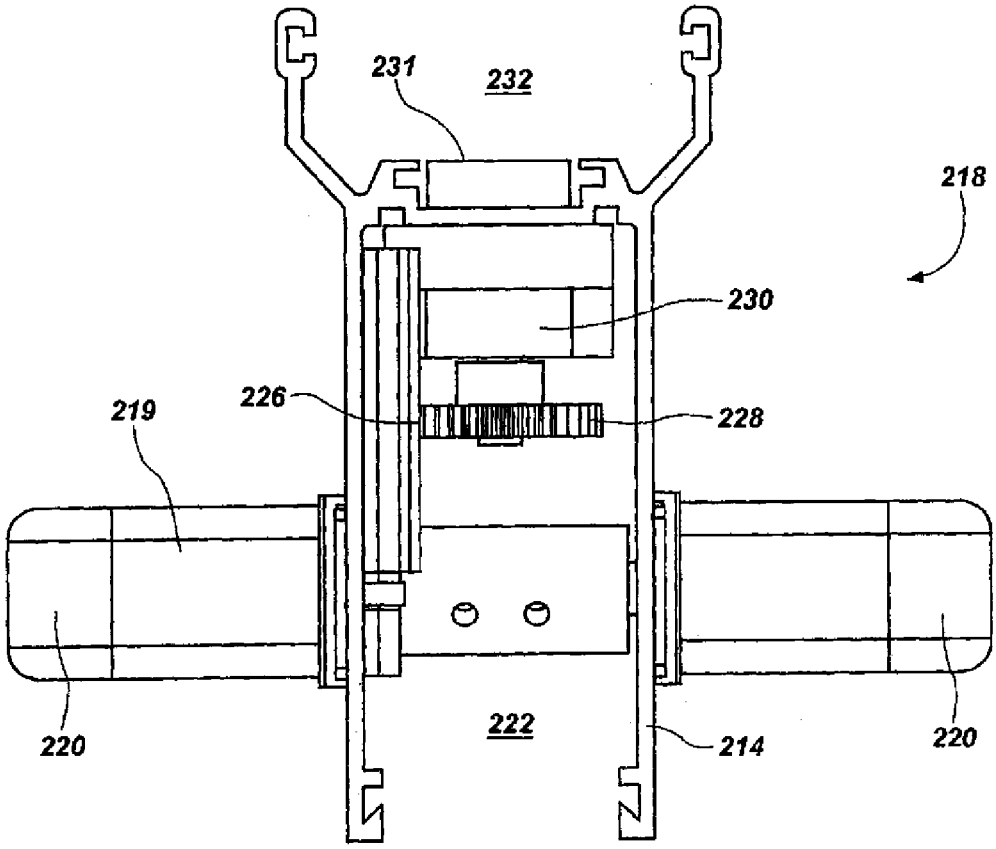
Figure 9:
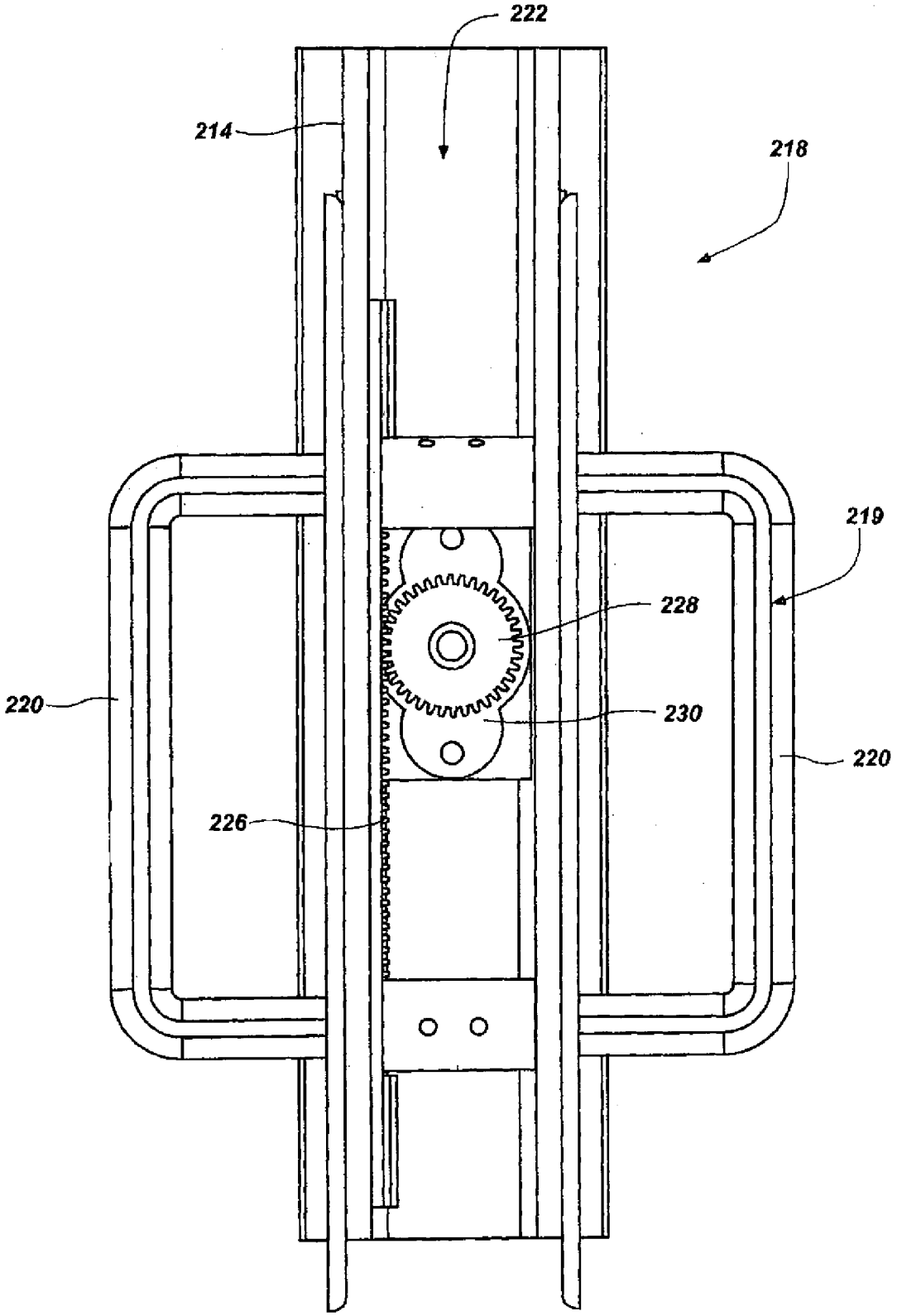
Figure 10:
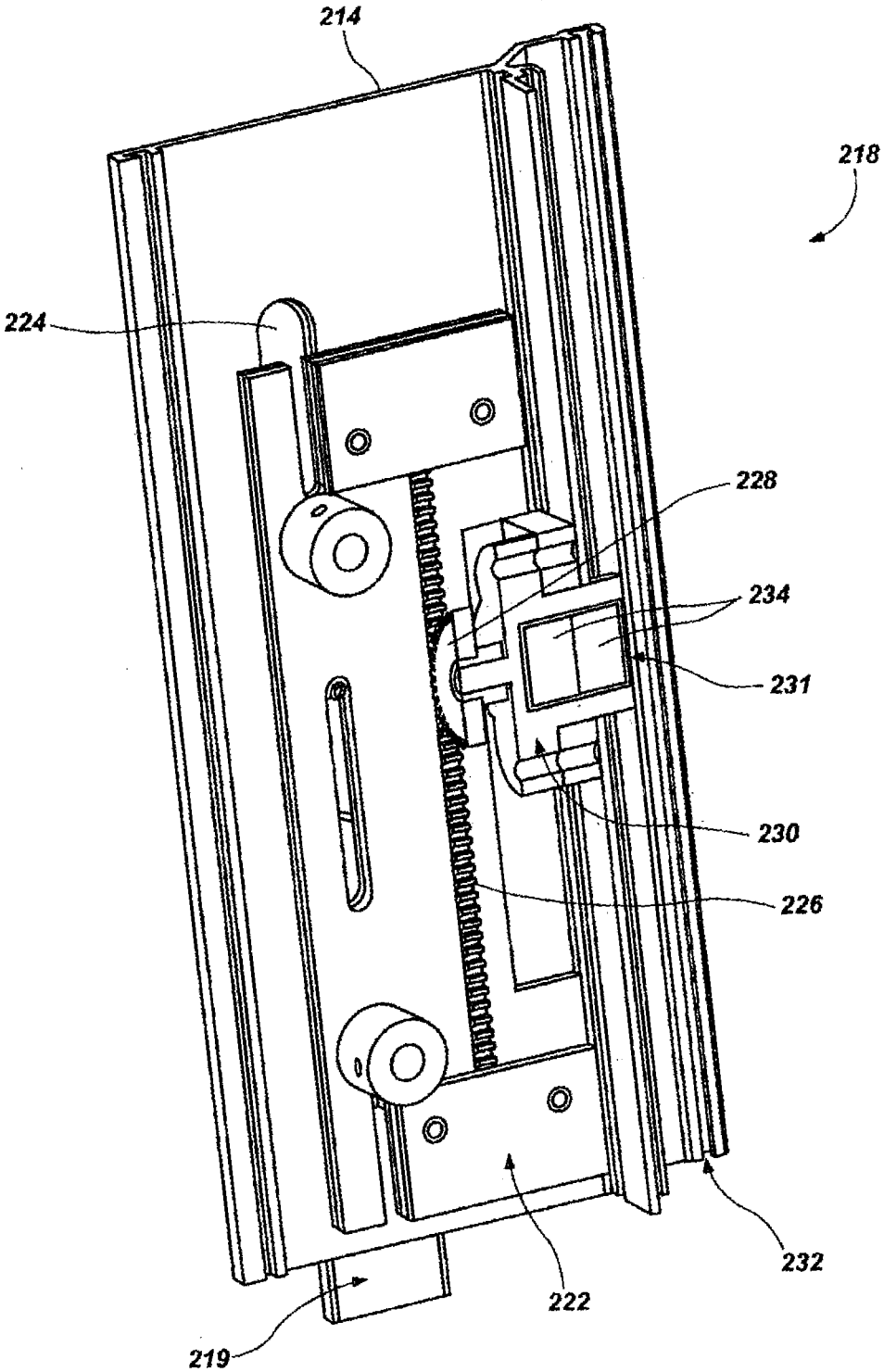
Figure 11:
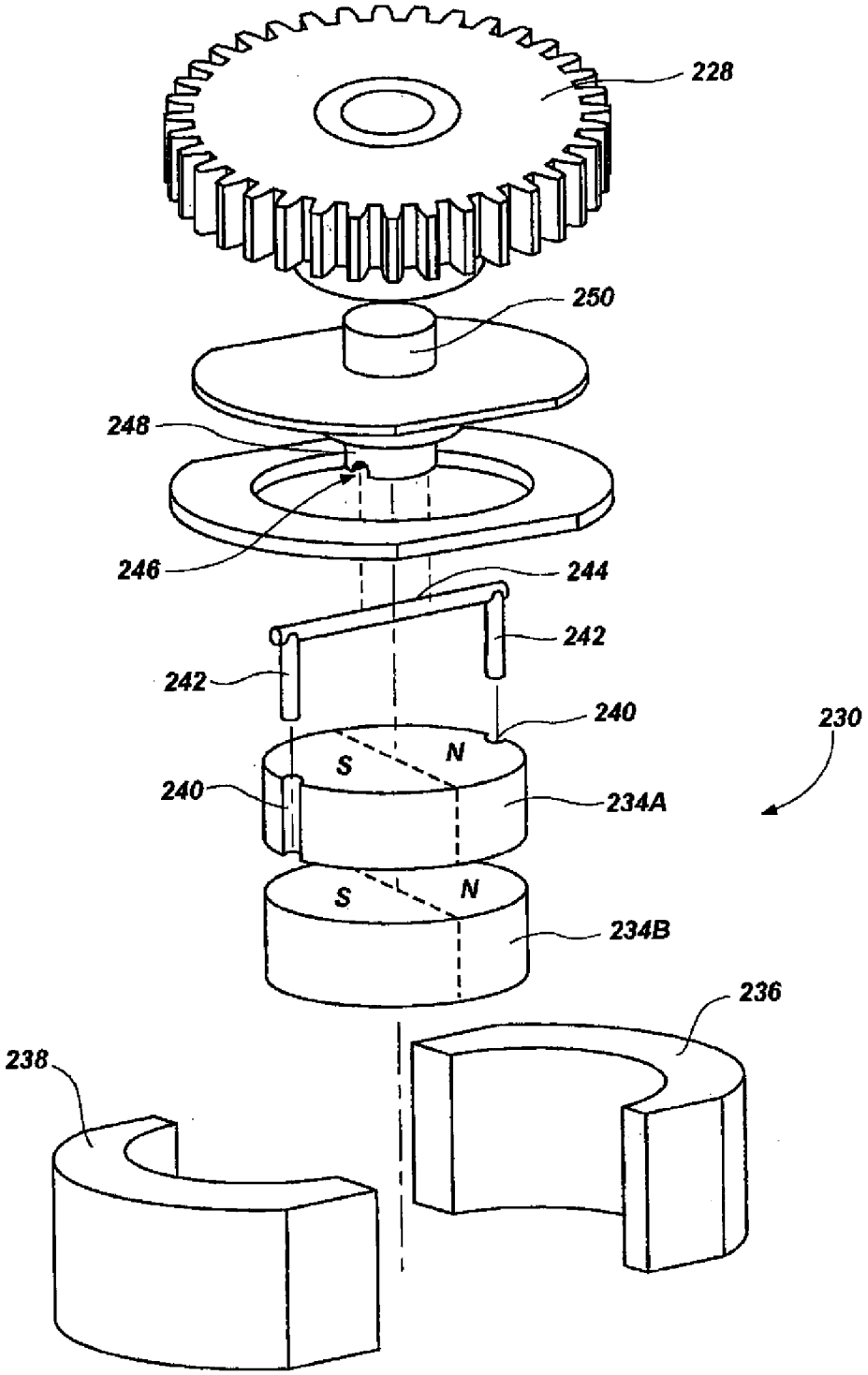

Referring to FIG. 11, a permanent magnet switch 230 is shown. A switchable permanent magnetic device, as disclosed in International Patent Application Publication No. WO2001/043147 to Kocijan et al., published Jun. 14, 2001, the disclosure of which is incorporated herein in its entirety by this reference, may be used as the permanent magnet switch 230. The permanent magnet switch 230 may include a first magnet 234A and a second magnet 234B, both of which may be essentially cylindrical. The magnets 234A and 234B may be housed in a housing made from pole pieces 236 and 238. Pole pieces 236 and 238 may be ferromagnetic. The second magnet 234B may be fixedly mounted in the housing and located below the first magnet 234A. The first magnet 234A may rotate within the housing. The first magnet 234A may be formed with notches 240 along its vertical side walls. These notches 240 may receive downwardly depending arms 242 of a bar 244. The bar 244 may be received inside a groove 246 formed on a boss 248. The boss 248 may be connected to a short bar 250 that, in turn, may be connected to a pinion 228. Rotation of the pinion 228 causes rotation of the first magnet 234A. When the first magnet 234A is positioned such that its north pole N substantially overlies the south pole S of the second magnet 234B and the south pole S of the first magnet 234A substantially overlies the north pole N of the second magnet 234B, the first and second magnets 234A, 234B act as an internal active magnetic shunt and as a result the external magnetic field applied by the permanent magnet switch 230 is negligible. Rotating the first magnet 234A one hundred eighty degrees (180°) about its axis of rotation brings the magnets into alignment such that the respective north pole N of the first magnet 234A substantially overlies the north pole N of the second magnet 234B and south pole S of the first magnet 234A substantially overlies the south pole S of the second magnet 234B. In this alignment, the external magnetic field from the permanent magnet switch 230 is significant and the permanent magnet switch 230 may apply a significant attractive magnetic force to another structure comprising a material responsive to the applied significant attractive magnetic force. Such permanent magnet switches 230 are available from Magswitch Technology, Inc. of Westminster, CO.

Figure 8:
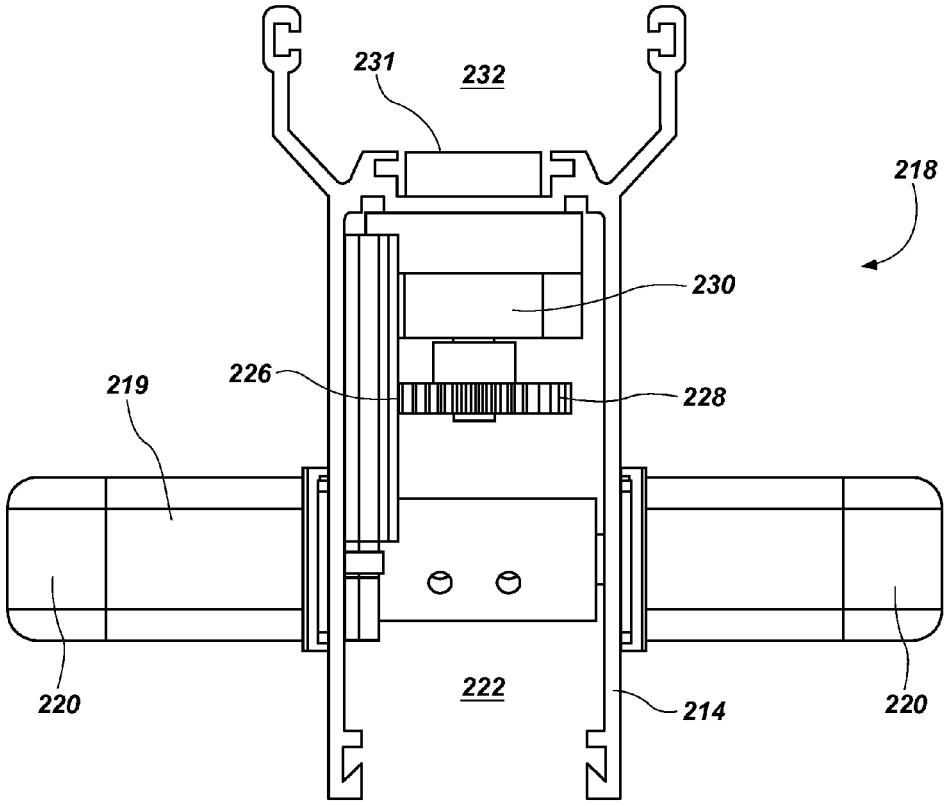
FIG. 8 is a top view of a securing mechanism for a partition system according to an embodiment of the present disclosure.
Figure 9:
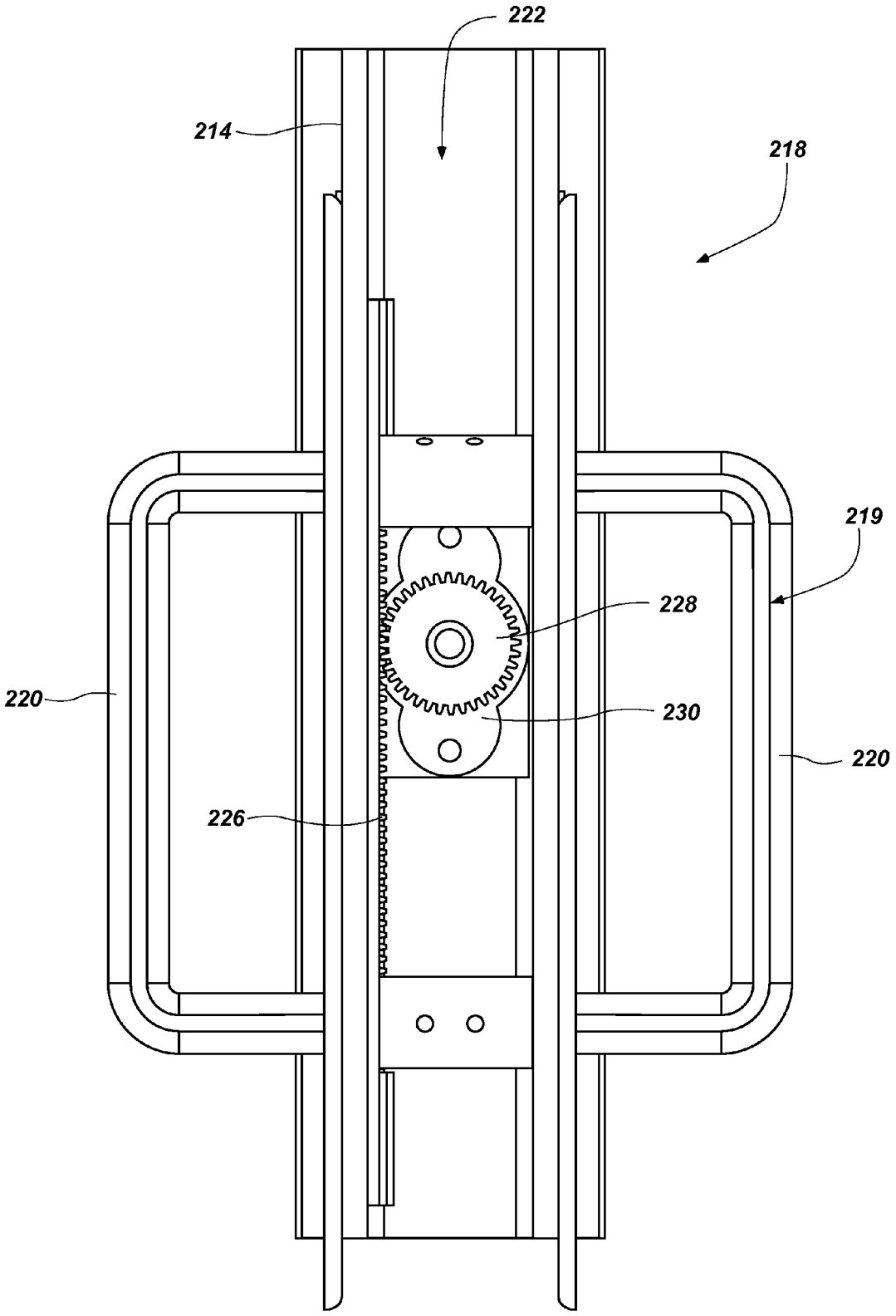
FIG. 9 is a front view of a securing mechanism for a partition system according to an embodiment of the present disclosure.
Figure 10:
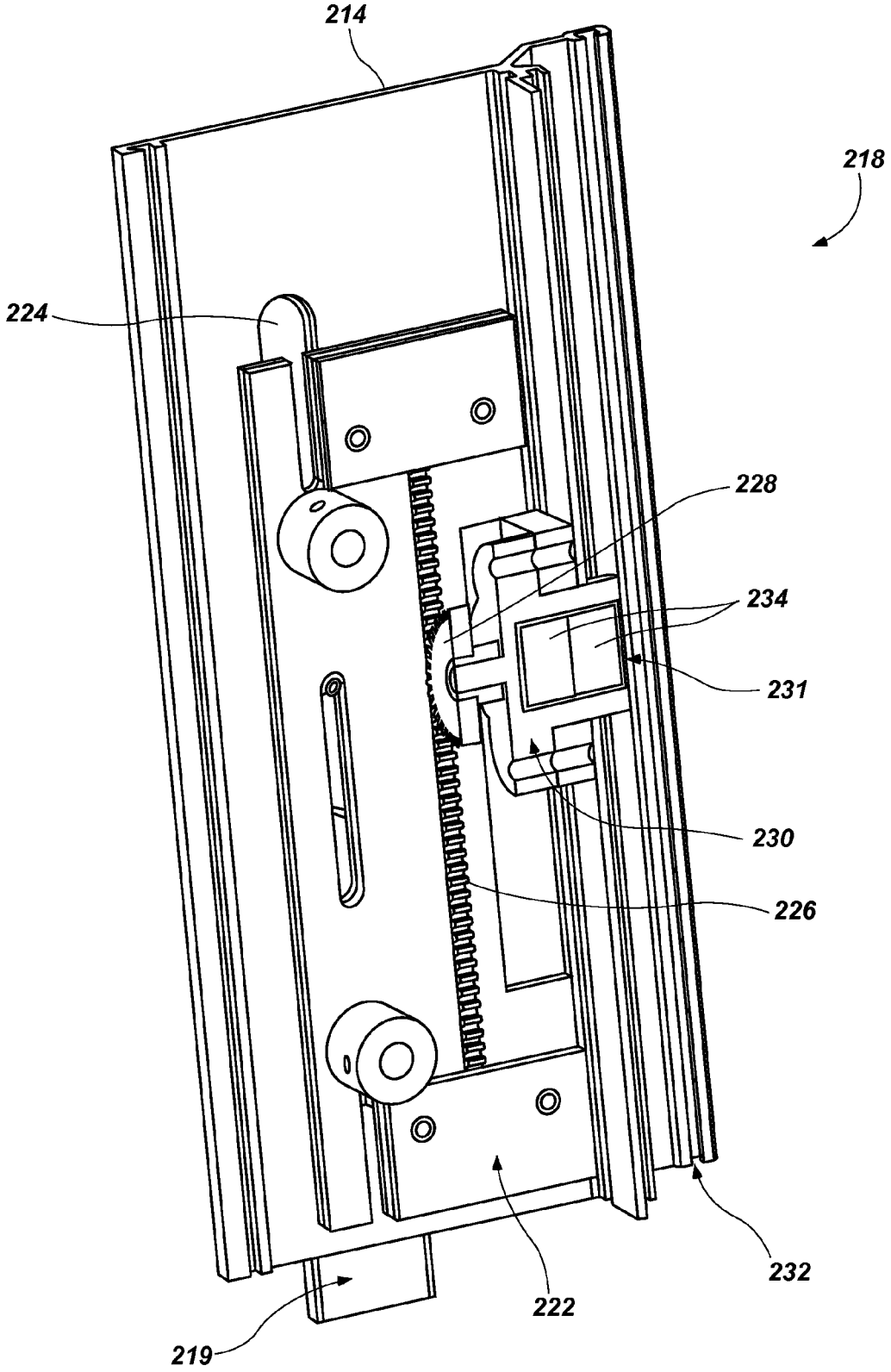
FIG. 10 is a cross-sectional view of a securing mechanism for a partition system according to an embodiment of the present disclosure.

Returning to FIGS. 6 through 10, the permanent magnet switch 230 may be attached to the lead post 214 using conventional attachment hardware, such as, for example, matched nuts and bolts or rivets. At least a portion of the permanent magnet switch 230 may at least partially protrude through the lead post 214 to an exterior connection portion 232, as best shown in FIGS. 8 and 10. Thus, the end 231 of the permanent magnet switch 230 may be configured to abut against a lead post 216 (FIG. 5) or door post, which may be generically referred to as post members, to which the lead post 214 of the first door 202A (FIG. 5) is to be secured. In other embodiments, the permanent magnet switch 230 may not abut against the lead post 216 or door post to which the lead post 214 of the first door 202A is to be secured, but may be sufficiently close that a magnetic field produced by the permanent magnet switch 230 resists separation of the first door 202A from the post member to which it is magnetically secured.

The rack 226 and pinion 228 may be cooperatively configured to switch the permanent magnet switch 230 off when the handles 220 are located in a first position at the top of the slots 224, and to switch the permanent magnet switch 230 on when the handles 220 are located in a second position at the bottom of the slots 224. In other embodiments, the permanent magnet switch 230 may be switched off when the handles 220 are at the bottom of the slots 224 and switched on when the handles 220 are at the top of the slots 224. For example, the rack 226 and pinion 228 may be configured to turn the permanent magnet switch 230 one hundred eighty degrees (180°) when the handles 220 are at either extreme along the longitudinal length of the slots 224. Thus, the cooperative configuration of the handles 220, the slots 224, the rack 226, the pinion 228, and the permanent magnet switch 230 may enable a user to selectively apply a significant magnetic field at a connection portion 232 of the lead post 214. In other embodiments, a plurality of permanent magnet switches 230 may be switched on and off by displacing the handles 220, for example, by attaching a pinion 228 to each permanent magnet switch 230.

The connection portion 232 of the lead post 214 may be configured to receive another post member, such as, for example, a lead post 216 of a second door 202B (see FIG. 5) or a door post, at least partially therein. With reference to FIG. 5, the lead post 216 of the second door 202B may comprise a material that is attracted by magnetic fields. For example, the lead post 216 may comprise iron, steel, ferrites, magnetite, lodestone, and other magnetically responsive materials as known in the art. In other embodiments, the lead post 216 of the second door 202B may comprise at least one discrete attachment plate configured to align with and be magnetically secured by the permanent magnet switch 230.

In operation, the lead post 214 of the first door 202A may be brought proximate to the lead post 216 of the second door 202B. The lead post 216 of the second door 202B may be at least partially inserted into the connection portion 232 of the lead post 214 of the first door 202A. In some embodiments, the lead post 214 of the first door 202A may abut against the lead post 216 of the second door 202B. The handles 220 may be displaced, switching the permanent magnet switch 230 on. Thus, the securing mechanism 218 may secure the first door 202A to the second door 202B using a significant attractive magnetic force. In other embodiments, an automatic mechanism, such as an electric solenoid, may be used to actuate the permanent magnet switch 230. The securing mechanism 218 may enable the doors 202A and 202B to resist a breakaway force applied in the common plane of doors 202A and 202B of at least twenty-five pounds (25 lbs). In other embodiments, the securing mechanism 218 may enable the doors 202A and 202B to resist a breakaway force of at least forty pounds (40 lbs). In yet other embodiments, the securing mechanism 218 may enable the doors 202A and 202B to resist a breakaway force of at least one hundred pounds (100 lbs). Put another way, permanent magnet switch 230 may apply a significant attractive magnetic force of, for example, up to twenty-five pounds (25 lbs), up to forty pounds (40 lbs), up to one hundred pounds (100 lbs), or greater to another post member, such as a lead post of another door or a door post attached to a wall, when the permanent magnet switch 230 is in the on position. To disengage the lead posts 214, 216, the handles 220 may be displaced, switching the permanent magnet switch 230 to the off position. Thus, the securing mechanism 218 may cease applying a significant attractive magnetic force to the lead post 216 of the second door 202B, enabling the second door 202B to be displaced away from the first door 202A with relatively little force. Accordingly, the securing mechanism 218 may enable a partition system 200 (see FIG. 5) to resist relatively high breakaway forces and enable the partition system 200 to be retracted with relatively little force.

Figure 1:
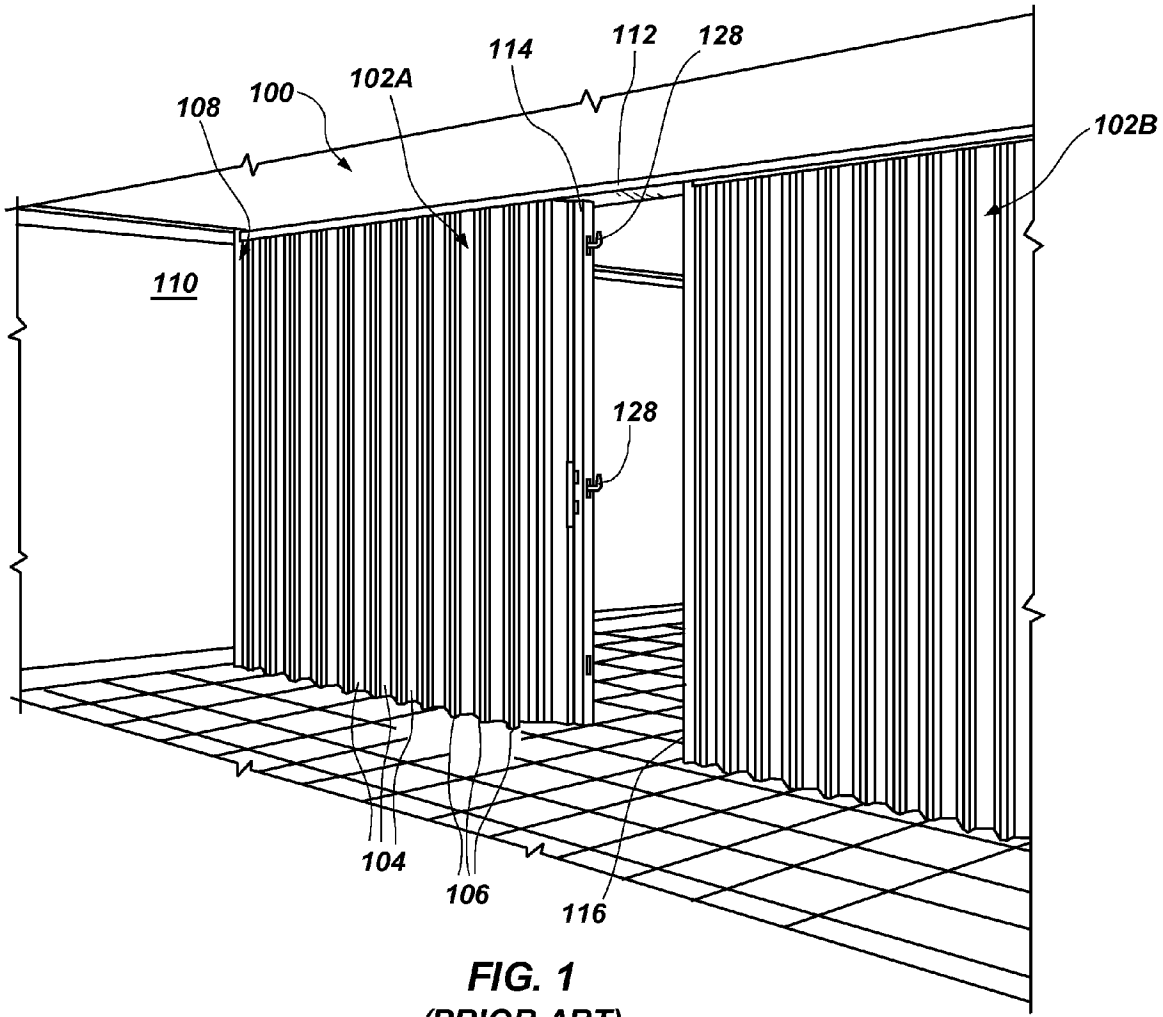
FIG. 1 (PRIOR ART)
FIG. 1 is an illustration of a prior art partition system.
Figure 2A:
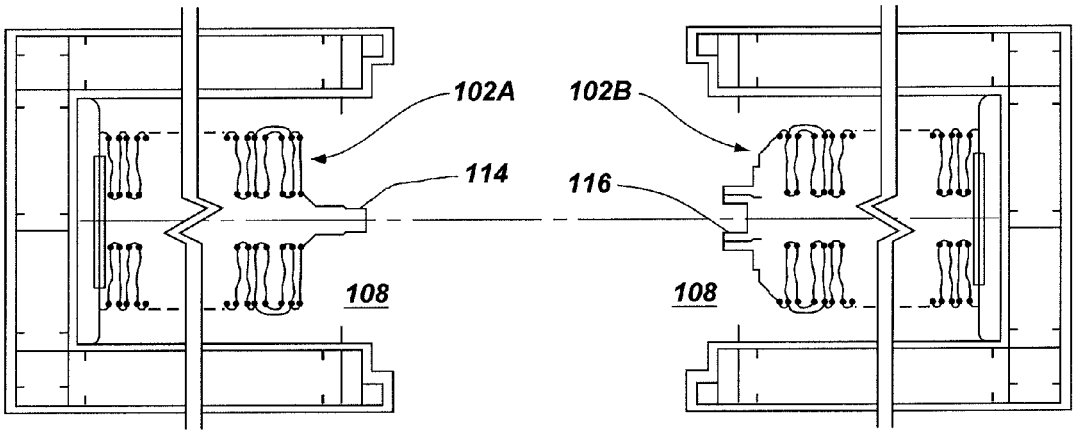
FIG. 2A (PRIOR ART)
FIG. 2A is a cross-sectional view of a prior art partition system in a bi-part configuration.
Figure 2B:
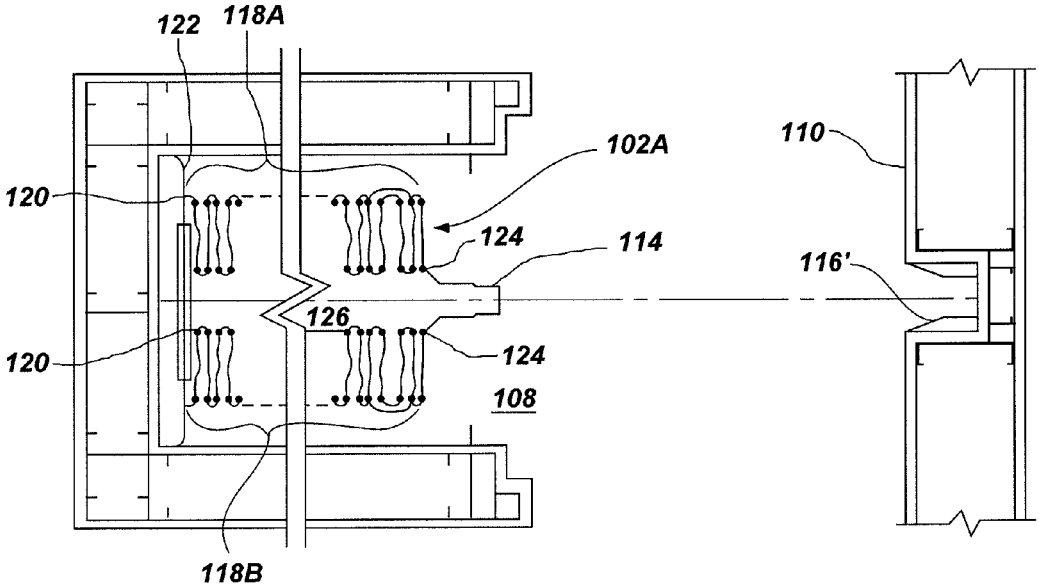
FIG. 2B (PRIOR ART)
FIG. 2B is a cross-sectional view of a prior art partition system comprising a single door.
Figure 3B:
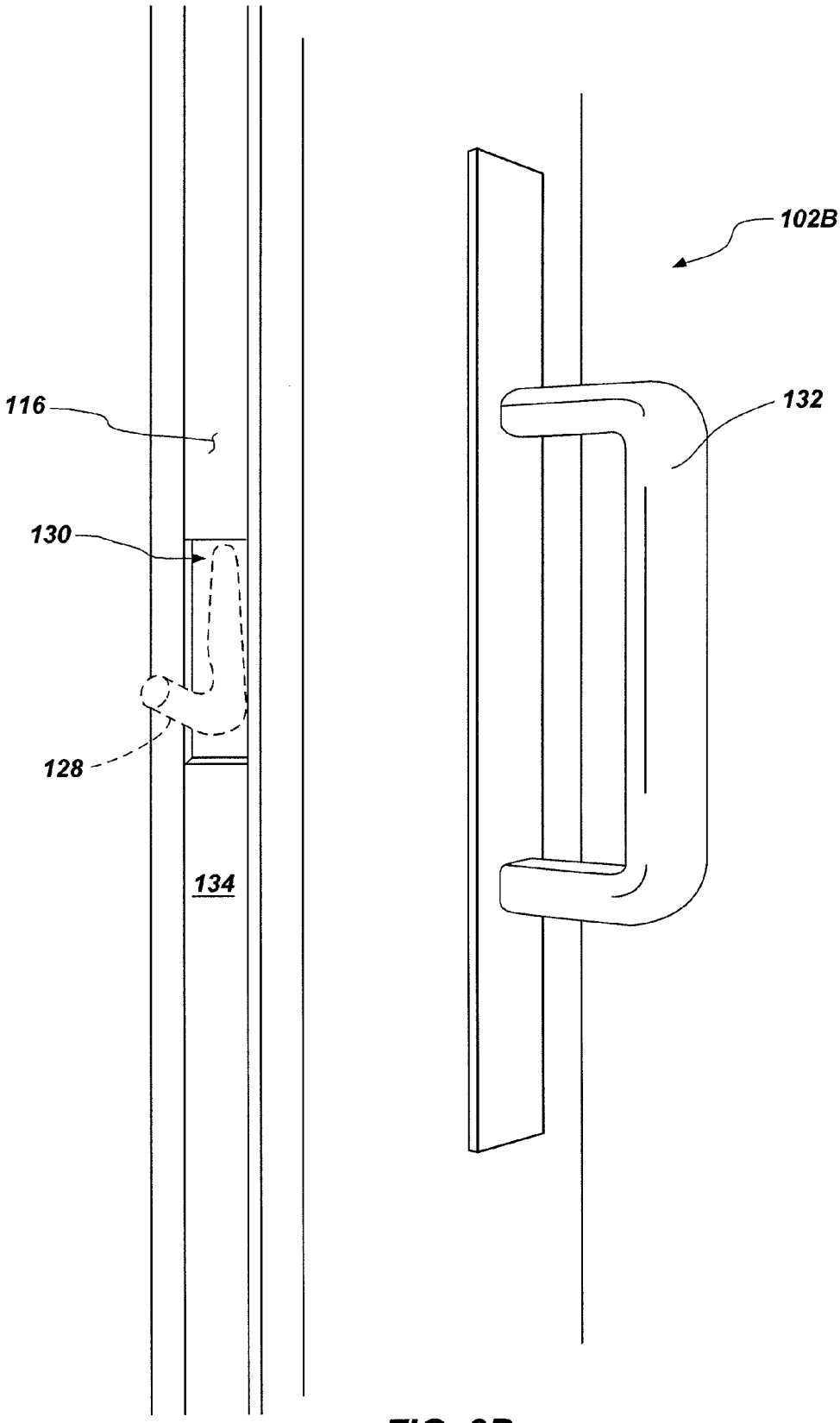
FIG. 3B (PRIOR ART)
FIG. 3B is an illustration of a prior art latch and associated latch openings for a partition system.
Figure 4:
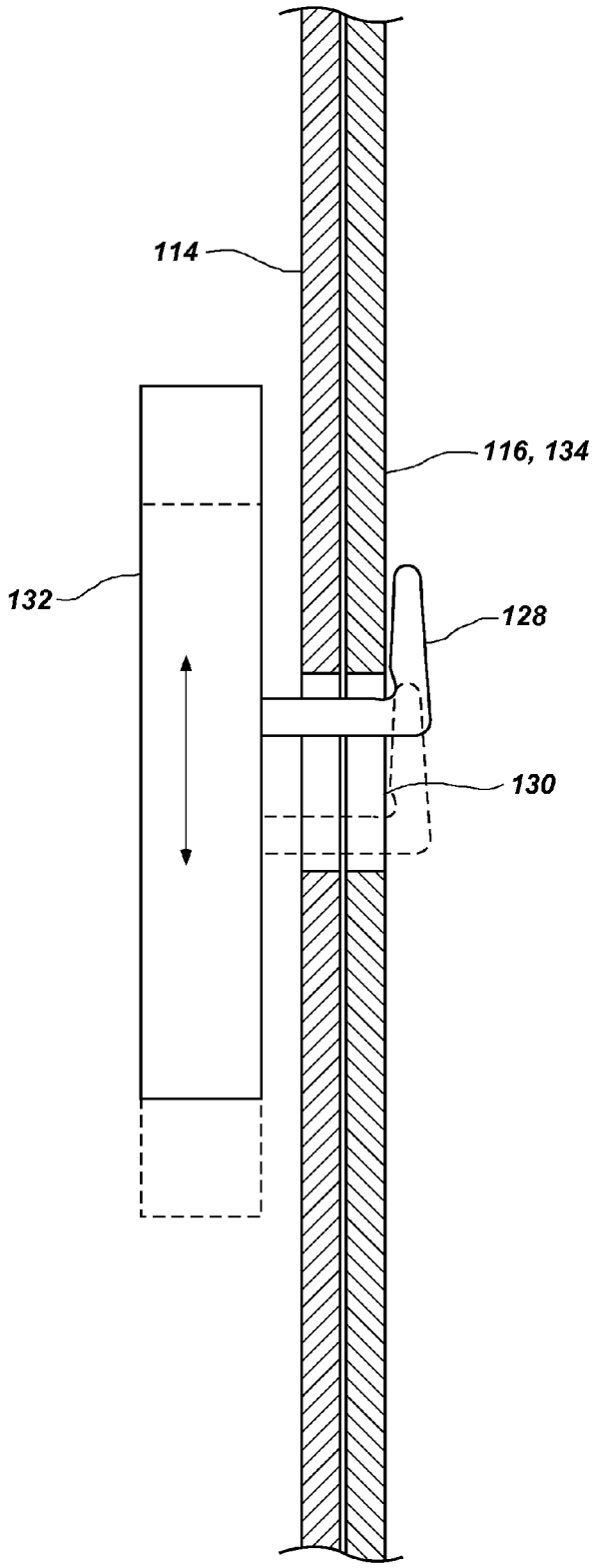
FIG. 4 (PRIOR ART)
FIG. 4 is a cross-sectional view of a prior art latch for a partition system.

In addition, the securing mechanism 218 may enable a user to secure a partition system 200 in an extended position without having to align the securing mechanism 218 or the lead post 214 to which it is attached precisely with attachment portions of another lead post 216 (or a door post 116' as shown in FIG. 2B). The permanent magnet switch 230 may draw the other lead post 216 (or door post 116' as shown in FIG. 2B) into alignment with the securing mechanism 218 and the lead post 214 to which it is attached.

While the present disclosure has been described herein with respect to certain embodiments, those of ordinary skill in the art will recognize and appreciate that it is not so limited. Rather, many additions, deletions, and modifications to the embodiments described herein may be made without departing from the scope of the disclosure as hereinafter claimed, including legal equivalents. In addition, features from one embodiment may be combined with features of another embodiment while still being encompassed within the scope of the disclosure as contemplated by the inventors.

What is claimed is:

1. A partition system, comprising:

a first post member attached to a foldable partition;

a securing mechanism attached to the first post member, the securing mechanism comprising at least one permanent magnet switch configured to selectively apply a significant attractive magnetic force and a switching mechanism configured to selectively rotate a first permanent magnet of the at least one permanent magnet switch relative to at least another permanent magnet of the at least one permanent magnet switch to apply the significant attractive magnetic force when a handle of a handle assembly is displaced, wherein the at least one permanent magnet switch is configured to apply the significant attractive magnetic force when a first north pole of the first permanent magnet substantially overlies a second north pole of the at least another permanent magnet and a first south pole of the first permanent magnet substantially overlies a second south pole of the at least another permanent magnet; and at least another post member comprising a material responsive to the applied significant attractive magnetic force of the at least one permanent magnet switch.

2. The partition system of claim 1, wherein the at least another post member comprises a lead post attached to another foldable partition.

3. The partition system of claim 1, wherein the at least another post member comprises a door post attached to a wall.

4. The partition system of claim 1, wherein the at least one permanent magnet switch comprises a plurality of permanent magnet switches.

5. The partition system of claim 1, wherein the switching mechanism comprises a handle assembly attached to the first post member.

6. The partition system of claim 5, wherein the handle assembly comprises a rack and pinion system configured to selectively rotate the first permanent magnet relative to the at least another permanent magnet to apply the significant attractive magnetic force when a handle of the handle assembly is displaced.

7. The partition system of claim 6, wherein the rack is attached to the handle and the pinion is operably coupled to the first permanent magnet of the at least one permanent magnet switch.

8. The partition system of claim 1, wherein the at least one permanent magnet switch is configured to selectively apply at least twenty-five pounds (25 lbs) of attractive magnetic force to the at least another post member.

9. The partition system of claim 1, wherein the permanent magnet switch is configured to selectively apply at least forty pounds (40 lbs) of attractive magnetic force to the at least another post member.

10. A method of securing a partition system, comprising:

bringing a first post member of a foldable partition proximate at least another post member; and manipulating a switching mechanism to rotate a first permanent magnet of at least one permanent magnet switch attached to the first post member relative to a second permanent magnet of the at least one permanent magnet switch to align a north pole of the first permanent magnet to overlie a north pole of the second permanent magnet and rotate a south pole of the first permanent magnet to overlie a south pole of the second permanent magnet to selectively apply a significant attractive magnetic force to the at least another post member.

11. The method of claim 10, wherein rotating the first permanent magnet relative to the second permanent magnet to selectively apply the significant attractive magnetic force to the at least another post member comprises manipulating the at least one permanent magnet switch attached to the first post member to selectively apply an attractive magnetic force of at least twenty-five pounds (25 lbs) to the at least another post member.

12. The method of claim 10, wherein rotating the first permanent magnet relative to the second permanent magnet to selectively apply the significant attractive magnetic force to the at least another post member comprises manipulating the at least one permanent magnet switch attached to the first post member to selectively apply an attractive magnetic force of at least forty pounds (40 lbs) to the at least another post member.

13. The method of claim 10, wherein rotating the first permanent magnet relative to the second permanent magnet to selectively apply the significant attractive magnetic force to the at least another post member comprises manipulating the at least one permanent magnet switch attached to the first post member to selectively apply an attractive magnetic force of at least one hundred pounds (100 lbs) to the at least another post member.

14. The method of claim 10, wherein manipulating the switching mechanism comprises manipulating a rack and pinion system.

15. The method of claim 14, wherein manipulating the rack and pinion system comprises displacing a handle of a handle assembly, the handle displacing the rack linearly and linear displacement of the rack causing rotational displacement of a pinion attached to the at least one permanent magnet switch.

16. The method of claim 10, wherein bringing the first post member of the foldable partition proximate the at least another post member comprises abutting a lead post of a first foldable partition against a lead post of another foldable partition.

17. The method of claim 10, wherein bringing the first post member of the foldable partition proximate the at least another post member comprises abutting a lead post of the foldable partition against a door post attached to a wall.

18. The method of claim 10, wherein bringing the first post member of the foldable partition proximate the at least another post member comprises abutting the at least one permanent magnet switch attached to the first post member against the at least another post member.

* * * * *

UNITED STATES PATENT AND TRADEMARK OFFICE

CERTIFICATE OF CORRECTION

PATENT NO. : 8,641,105 B2
APPLICATION NO. : 13/013583
DATED : February 4, 2014
INVENTOR(S) : E. Carl Goodman, Ronald A. Smart and Craig G. Bell It is certified that error appears in the above-identified patent and that said Letters Patent is hereby corrected as shown below:

Replace the Title Page with the attached Title Page.

In the drawings:
Replace the drawings with the attached drawings.

Signed and Sealed this
Third Day of June, 2014

Michelle K. Lee

Michelle K. Lee
*Deputy Director of the United States Patent and Trademark Office*

(12) United States Patent
Goodman et al.

(10) Patent No.: US 8,641,105 B2
(45) Date of Patent: Feb. 4, 2014

(54) SECURING MECHANISMS FOR PARTITIONS, PARTITION SYSTEMS INCLUDING SAME, AND RELATED METHODS

(75) Inventors: E. Carl Goodman, Bountiful, UT (US); Ronald A. Smart, Sandy, UT (US); Craig G. Bell, South Jordan, UT (US)

(73) Assignee: Won-Door Corporation, Salt Lake City, UT (US)

( * ) Notice: Subject to any disclaimer, the term of this patent is extended or adjusted under 35 U.S.C. 154(b) by 280 days.

(21) Appl. No.: 13/013,583

(22) Filed: Jan. 25, 2011

(65) Prior Publication Data

US 2012/0187703 A1 Jul. 26, 2012

(51) Int. Cl.
*E05C 17/56* (2006.01)
*E05C 19/16* (2006.01)

(52) U.S. Cl.
USPC ..... 292/251.5

(58) Field of Classification Search
USPC ..... 292/251.5
See application file for complete search history.

(56) References Cited

U.S. PATENT DOCUMENTS

| | | | | | |
|---|---|---|---|---|---|
| 2,797,655 | A * | 7/1957 | Morehouse | 109/63.5 |
| 3,184,654 | A * | 5/1965 | Bey | 335/295 |
| 3,288,511 | A * | 11/1966 | Tavano | 292/251.5 |
| 3,596,958 | A * | 8/1971 | Bowerman | 292/201 |
| 4,055,824 | A * | 10/1977 | Baermann | 335/288 |
| 4,686,841 | A * | 8/1987 | Prunbauer et al. | 70/276 |
| 6,076,873 | A * | 6/2000 | Jung | 294/65.5 |
| 6,707,360 | B2 * | 3/2004 | Underwood et al. | 335/288 |
| 6,765,330 | B2 * | 7/2004 | Baur | 310/103 |
| 7,267,378 | B2 * | 9/2007 | Drumm | 292/251.5 |
| 7,845,384 | B2 * | 12/2010 | Goodman et al. | 160/118 |
| 7,942,458 | B2 * | 5/2011 | Patterson | 292/251.5 |
| 8,016,330 | B2 * | 9/2011 | Fullerton et al. | 292/251.5 |
| 2007/0007775 | A1 * | 1/2007 | Gallas et al. | 292/251.5 |
| 2009/0027149 | A1 * | 1/2009 | Kocijan | 335/288 |

FOREIGN PATENT DOCUMENTS

| | | | | |
|---|---|---|---|---|
| DE | 145325 | * | 12/1902 | |
| DE | 2455520 | * | 5/1976 | |
| JP | 54013000 A | * | 1/1979 | E05C 19/16 |
| JP | 54102046 A | * | 8/1979 | E05C 19/16 |
| JP | 54109230 A | * | 8/1979 | E05C 19/16 |
| JP | 5340149 | * | 12/1993 | |
| WO | 0143147 A1 | | 6/2001 | |
| WO | 2007033437 A1 | | 3/2007 | |
| WO | 2009000008 A1 | | 12/2008 | |
| WO | 2010020006 A1 | | 2/2010 | |
| WO | 2010135788 A1 | | 12/2010 | |

* cited by examiner

*Primary Examiner* — Carlos Lugo
(74) *Attorney, Agent, or Firm* — TraskBritt

(57) ABSTRACT

Partition systems comprise a first post member attached to a foldable partition, a securing mechanism attached to the first post member and comprising at least one permanent magnet switch configured to selectively apply a significant attractive magnetic force, and at least another post member comprising a material responsive to the applied significant attractive magnetic force of the at least one permanent magnet switch. Methods of securing a partition system comprise bringing a first post member of a foldable partition proximate at least another post member; and manipulating the at least one permanent magnet switch attached to the first post member to selectively apply a significant attractive magnetic force to the at least another post member.

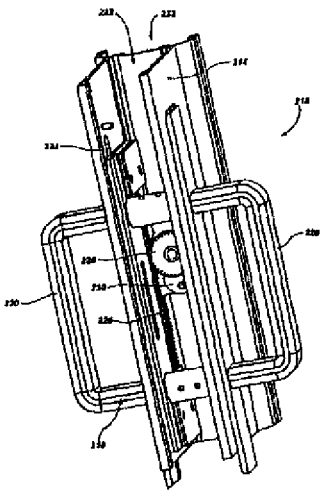

18 Claims, 11 Drawing Sheets